US011415143B2

(12) United States Patent
Bourne et al.

(10) Patent No.: US 11,415,143 B2
(45) Date of Patent: Aug. 16, 2022

(54) PROCESS FLUID LUBRICATED PUMP AND SEAWATER INJECTION SYSTEM

(71) Applicant: Sulzer Management AG, Winterthur (CH)

(72) Inventors: Matthew Bourne, Katy, TX (US); Thomas Felix, Leeds (GB); Karel De Raeve, Winterthur (CH); Simon Gassmann, Zürich (CH)

(73) Assignee: SULZER MANAGEMENT AG, Winterthur (CH)

( * ) Notice: Subject to any disclaimer, the term of this patent is extended or adjusted under 35 U.S.C. 154(b) by 106 days.

(21) Appl. No.: 16/774,737

(22) Filed: Jan. 28, 2020

(65) Prior Publication Data

US 2020/0263680 A1 Aug. 20, 2020

(30) Foreign Application Priority Data

Feb. 18, 2019 (EP) ..... 19157862

(51) Int. Cl.
*F04D 29/041* (2006.01)
*F04D 1/06* (2006.01)
(Continued)

(52) U.S. Cl.
CPC ..... *F04D 29/0416* (2013.01); *F04D 1/006* (2013.01); *F04D 1/06* (2013.01);
(Continued)

(58) Field of Classification Search
CPC . F04D 1/006; F04D 1/06; F04D 13/06; F04D 13/086; F04B 47/06
See application file for complete search history.

(56) References Cited

U.S. PATENT DOCUMENTS 3,171,355 A * 3/1965 Harris ..... F04D 13/10 417/365
3,764,236 A 10/1973 Carter
(Continued)

FOREIGN PATENT DOCUMENTS

CN 201521490 U 7/2010
CN 107762890 A 3/2018
(Continued)

OTHER PUBLICATIONS

Extended European Search Report dated Aug. 13, 2019 in corresponding European Patent Application No. 19157862.4, filed Feb. 18, 2019.

*Primary Examiner* — Charles G Freay
(74) *Attorney, Agent, or Firm* — Global IP Counselors, LLP

(57) ABSTRACT

A process fluid lubricated pump includes a pump having a pump shaft extending from a drive end to a non-drive end to rotate about an axial direction, a first pump section having a first set of impellers fixedly mounted on the pump shaft to increase the pressure of the process fluid, a drive to exert a torque on the drive end of the pump shaft to drive the rotation of the pump shaft, a first balance drum fixedly connected to the pump shaft between the pump and the drive end of the pump shaft, the first balance drum defining a first front side facing the pump and a first back side, and a second balance drum fixedly connected to the pump shaft between the pump and the non-drive end of the pump shaft, the second balance drum defining a second front side facing the pump and a second back side.

17 Claims, 13 Drawing Sheets

(51) Int. Cl.

| | |
|---|---|
| ***F04D 13/08*** | (2006.01) |
| ***F04D 29/58*** | (2006.01) |
| ***F04D 1/00*** | (2006.01) |
| ***F04D 13/06*** | (2006.01) |
| *F04B 47/06* | (2006.01) |
| *F04D 29/66* | (2006.01) |

(52) U.S. Cl.
CPC ..... *F04D 13/06* (2013.01); *F04D 13/086* (2013.01); *F04D 29/5806* (2013.01); *F04D 29/586* (2013.01); *F04D 29/5866* (2013.01); *F04B 47/06* (2013.01); *F04D 29/669* (2013.01)

(56) References Cited

U.S. PATENT DOCUMENTS

| | | | | |
|---|---|---|---|---|
| 8,137,081 | B2 * | 3/2012 | Gausmann | F04D 17/122 417/423.12 |
| 2011/0280742 | A1 * | 11/2011 | Guenard | F04D 17/122 417/245 |
| 2016/0348687 | A1 * | 12/2016 | Gassmann | F04D 29/5873 |
| 2020/0340480 | A1 * | 10/2020 | Felix | F04D 13/022 |
| 2021/0088056 | A1 * | 3/2021 | Radcliffe | F04D 29/167 |
| 2021/0324862 | A1 * | 10/2021 | Widmer | F04D 29/106 |

FOREIGN PATENT DOCUMENTS

| | | | |
|---|---|---|---|
| JP | H09-72292 | A | 3/1997 |
| JP | 2008-002412 | A | 1/2008 |
| WO | 2014/206919 | A | 12/2014 |

* cited by examiner

PROCESS FLUID LUBRICATED PUMP AND SEAWATER INJECTION SYSTEM

CROSS-REFERENCE TO RELATED APPLICATION

This application claims priority to European Patent Application No. 19157862.4, filed Feb. 18, 2019, the content of which is hereby incorporated herein by reference.

BACKGROUND

Field of the Invention

The invention relates to a process fluid lubricated pump for conveying a process fluid to a seawater injection system.

Background Information

Conventional process fluid lubricated pumps for conveying a process fluid are used in many different industries. An important example is the oil and gas processing industry, where process fluid lubricated pumps are designed e.g. as multiphase pumps for conveying hydrocarbon fluids, for example for extracting the crude oil from the oil field or for transportation of the oil/gas through pipelines or within refineries. Another application of process fluid lubricated pumps in the oil and gas industry is the injection of a process fluid, in most cases water and in particular seawater, into an oil reservoir. For such applications, said pumps are designed as water injection pumps supplying seawater at high pressure to a well that leads to a subterranean region of an oil reservoir. A typical value for the pressure increase generated by such a water injection pump is 200-300 bar (20-30 MPa) or even more.

Water injection into oil reservoirs is a well-known method for increasing the recovery of hydrocarbons from an oil or gas field. The injected water maintains or increases the pressure in the reservoir thereby driving the oil or the hydrocarbons towards and out of the production well.

In some applications, raw seawater is injected into the oil reservoir. However, in many applications the seawater is pretreated to avoid negative impacts on the oil reservoir, such as acidifying the oil, e.g. by hydrogen sulfide ($H_2S$), or blocking pores or small passages in the reservoir, e.g. by means of sulfates. To achieve the desired seawater quality, the seawater is passed through a series of ever-finer filters providing a microfiltration of the seawater. In addition, biological or electrochemical processes can be used to pretreat the seawater. Usually the final step of the filtration is a nanofiltration, in particular to remove the sulfates from the seawater. Nanofiltration is a membrane filtration process requiring to supply the water to the membrane unit with a pressure of typically 25-50 bar (2.5-5.0 MPa). Particularly for reverse osmosis filtration the required pressure can even be higher. After the nanofiltration process the seawater is supplied to the water injection pump, pressurized and injected into the subterranean region, where the oil reservoir is located. Thus, pretreating and injecting the seawater into the oil reservoir usually requires two pumps, namely a membrane feed pump for supplying the membrane filtration unit with the seawater and a water injection pump for supplying the filtered seawater to the well for introducing the seawater into the oil reservoir.

SUMMARY

In view of an efficient exploitation of oil and gas fields, there is nowadays an increasing demand for pumps and in particular water injection pumps that can be installed directly on the sea ground in particular down to a depth of 100 m, down to 500 m or even down to more than 1,000 m beneath the water surface. Needless to say that the design of such pumps is challenging, in particular because these pumps operate in a difficult subsea environment for a long time period with as little as possible maintenance and service work. This requires specific measures to minimize the amount of equipment involved and to optimize the reliability of the pump. In view of water injection pumps deployed on the sea ground and the pretreatment of the seawater, the membrane feed pump might be dispensed with, if the seawater injection system is installed in such a depth that the ambient water pressure is sufficient to feed the membrane filtration unit. For example, in 500 m below the water surface the hydrostatic pressure of the seawater is already about 50 bar, which might be high enough to feed the membrane filtration unit.

WO 2014/206919 discloses a subsea seawater filtration and treatment system with both a feed pump to supply seawater to a sulfate removal unit (membrane unit) and a water injection pump. In order to minimize the amount of equipment WO 2014/206919 proposes to use two different pump stages driven by a common motor, wherein one of the pump stages is used as feed pump to supply the seawater to the sulfate removal unit, and the other pump stage is used as the water injection pump.

It goes without saying that for subsea installations on the sea ground the reliability of a pump and the minimization of wear and degradation within the pump are of utmost importance.

It is therefore an object of the invention to propose an improved or an alternative process fluid lubricated pump that is in particular suited for subsea applications and for deployment on the sea ground. The pump should have a low complexity with regard to the equipment, low wear and a high reliability in operation. In particular, the pump should be a water injection pump for injecting seawater in a subterranean region. In addition, it is an object of the invention to propose a seawater injection system comprising such a pump.

The subject matter of the invention satisfying these objects is characterized by the features disclosed herein.

Thus, according to the invention, a process fluid lubricated pump is proposed for conveying a process fluid, having a common housing, a pump unit arranged in the common housing, and a drive unit arranged in the common housing, wherein the common housing comprises a low pressure inlet and a high pressure outlet for the process fluid. The pump unit comprises a pump shaft extending from a drive end to a non-drive end of the pump shaft and configured for rotating about an axial direction. The pump unit further comprises a first pump section having a first set of impellers fixedly mounted on the pump shaft and configured for increasing the pressure of the process fluid. The drive unit is configured to exert torque on the drive end of the pump shaft for driving the rotation of the pump shaft. A first balance drum is fixedly connected to the pump shaft between the pump unit and the drive end of the pump shaft, the first balance drum defining a first front side facing the pump unit and a first back side. A first relief passage is provided between the first balance drum and a first stationary part configured to be stationary with respect to the common housing, the first relief passage extending from the first front side to the first back side. A second balance drum is fixedly connected to the pump shaft between the pump unit and the non-drive end of the pump shaft, the second balance drum defining a second front side facing the pump unit and a second back side. A second relief passage is disposed between the second balance drum and a second stationary part configured to be stationary with respect to the common housing, the second relief passage extending from the second front side to the second back side. A balance line connects the first back side and the second back side.

By providing a balance drum at both ends of the pump shaft, namely a first balance drum adjacent to the drive end of the pump shaft and a second balance drum adjacent to the non-drive end of the pump shaft, the rotor dynamic is considerably improved. The rotor comprises all the rotating parts of the pump unit, namely the pump shaft, all impellers and the balance drums fixed to the pump shaft. In particular, the improved rotor dynamic results from an increased rotor stability. Each balance drum contributes to the rotor stability and enhances the rotor stability. An increased rotor stability results in a considerably reduced risk of wear, in particular in the bearing units supporting the pump shaft. In addition, the improved rotor dynamic also enhances the reliability and reduces the susceptance to failure.

In many applications, particularly in subsea applications, the pump is a vertical pump, i.e. with the pump shaft extending in the direction of gravity. In addition, the vertical pump is quite often designed with the drive unit arranged on top of the pump unit.

Especially in this configuration, pumps known from the prior art can have problems with the rotor stability. Vibrations of the pump shaft can occur and the pump shaft may be whirling. In particular, this whirling of the pump shaft is detrimental for the bearing units and can cause considerably enhanced wear and premature failure or damage of the bearing unit.

The two balance drums provided according to the invention considerably enhance the rotor stability and at least strongly reduce the whirling of the pump shaft, in particular in a vertical pump with the drive unit arranged on top of the pump unit.

The process lubricated pump according to the invention is particularly suited as a water injection pump for injecting seawater into a subterranean region. In such applications the process fluid is seawater. The pump can receive the filtered seawater from a filtration unit or a sulfate removal unit the outlet of which is connected to the low pressure inlet of the pump. The first set of impellers of the pump unit increases the pressure of the seawater and discharges the pressurized water through the high pressure outlet. The high pressure outlet can be in fluid communication with a well leading into the subterranean oil reservoir. Thus, the pressurized water is injected by the pump through the well into the oil reservoir.

Depending for example on the depth below the water surface, at which the pump is installed, the hydrostatic pressure of the seawater can be sufficient for feeding a membrane filter unit, such as a sulfate removal unit (SRU). If the pump is e.g. installed at a depth of 500 m below the water surface the hydrostatic pressure of the seawater is 50 bar (5.0 MPa) which is in many applications sufficient for supplying the membrane filter unit. The seawater is first passed through one filter unit or a series of filter units providing microfiltration. The filtered seawater is then supplied to the membrane filtration units for the final filtration process to achieve the required seawater quality or purity. The membrane filtration units provides for nanofiltration of the seawater. The permeate outlet of the membrane filtration unit receives the depleted or purified seawater, e.g. the seawater from which sulfates have been removed. From the permeate outlet the nanofiltered seawater is supplied to the low pressure inlet of the pump. The first pump section increases the pressure of the seawater, e.g. by 200-300 bar (20-30 MPa) and discharges the pressurized seawater through the high pressure outlet. The high pressure outlet is in fluid communication with a well or the like for injecting the purified seawater into a subterranean region where the oil reservoir is located.

In other applications, e.g. when the pump is installed in shallow water for example at a depth of 200 m below the water surface, a feed pump can be required or can be advantageous to supply the seawater to the membrane filtration unit. In particular for these applications it is a preferred embodiment that the pump unit further comprises a second pump section having a second set of impellers fixedly mounted on the pump shaft and configured for increasing the pressure of the process fluid. The first pump section and the second pump section are arranged adjacent to each other with respect to the axial direction. A throttling device is arranged between the first pump section and the second pump section for allowing leakage of the process fluid from the first pump section to the second pump section. The common housing further comprises an increased pressure outlet and an increased pressure inlet for the process fluid. The second pump section receives the process fluid from the low pressure inlet and to discharge the process fluid through the increased pressure outlet, and the first pump section receives the process fluid from the increased pressure inlet and to discharge the process fluid through the high pressure outlet.

According to this embodiment two pump sections are disposed on the same pump shaft constituting a "two-in-one" pump. The second pump section can be used as a feed pump for providing seawater to the membrane filtration unit and the first pump section can be used as water injection pump, receiving the filtered seawater from the membrane filtration unit and injecting the pressurized seawater into the oil reservoir. According to a preferred design the low pressure inlet of the pump is connected to the outlet of a microfiltration unit to receive filtered seawater from the microfiltration unit. The second pump section increases the pressure of the seawater, e.g. by 20-50 bar (2-5 MPa) or any other value that is suited for supplying the seawater to the membrane filtration unit. The second pump section discharges the pressurized seawater through the increased pressure outlet, which is in fluid communication with the inlet of the membrane filtration unit. The permeate line of the membrane filtration unit, which receives the nanofiltered seawater, is in fluid communication with the increased pressure inlet of the pump for supplying the nanofiltered seawater to the first pump section. The first pump section increases the pressure of the seawater, e.g. by 200-300 bar (20-30 MPa) or any other value that is suited for water injection and discharges the pressurized seawater through the high pressure outlet. The high pressure outlet is in fluid communication with a well or the like for injecting the purified seawater into a subterranean region where the oil reservoir is located.

Providing both the first and the second pump section on the same pump shaft considerably reduces the required equipment because instead of two separate pumps with each comprising a separate drive, there is only one pump with two pump sections arranged on a common pump shaft and driven by the same drive unit. This configuration considerably reduces the complexity of the entire system, e.g. a subsea seawater injection system, as well as the cost, the mass, the risks (e.g. risk of failure) and the footprint of the system.

When using the second pump section as a feed pump for the membrane filtration unit the process fluid lubrication of the pump provides the additional advantage that there is no risk to contaminate the membrane of the membrane filtration unit by chemicals or any other substances that are detrimental to the membrane. Since the feed pump, i.e. the second pump section, which is arranged upstream of the membrane filtration unit, is only lubricated by the process fluid, namely seawater, there is no risk that any chemicals, such as lubrication oil or the like, enters the membrane filtration unit. Thus, the membrane, which is usually susceptible to degradation by chemicals, is prevented from being contaminated.

The throttle device, which is arranged between the first and the second pump section, can generate additional thrust acting on the pump shaft. For example, the throttle device can comprise an additional balance drum or a center bush or a throttle sleeve (also referred to as throttle bush), that is fixedly connected to the pump shaft, and an annular throttle gap surrounding the balance drum or the center bush or the throttle sleeve, respectively. According to other embodiments the throttle device can be configured, so that it does not generate an additional thrust acting upon the pump shaft. For example, the throttle device can comprise an annular throttle gap which is arranged directly adjacent to the pump shaft and surrounding the pump shaft.

According to a preferred design one of the first front side and the second front side is in fluid communication with the high pressure outlet. Thus, the first front side defined by the first balance drum or the second front side defined by the second balance drum is exposed to the high pressure, which is generated by the first pump section. Therefore, the entire pressure difference of the process fluid between the pressure at the high pressure outlet and the pressure at the low pressure inlet can be used for the pressure drop over the two balance drums.

According to a particularly preferred embodiment, the pump is designed as a seal-less pump without a mechanical seal. A mechanical seal is usually used for the sealing of the rotating shaft of a pump and shall prevent the leakage of the process fluid along the shaft of the pump. Typically, a mechanical seal comprises a stator and a rotor. The rotor is connected in a torque-proof manner with the shaft of the pump and the stator is fixed with respect to the pump housing such that the stator is secured against rotation. During rotation of the shaft the rotor is in sliding contact with the stator thus performing the sealing action. Although such mechanical seals are widely spread within the technology of centrifugal pumps they are somewhat problematic for subsea applications because they are quite complicated and usually require additional equipment, which is often considered as a drawback for subsea applications. Therefore, it is preferred that the pump according to the invention is designed as a seal-less pump, i.e. a pump that has no mechanical seal. In many applications this requires that the pump unit and the drive unit are flooded with the process fluid. The advantage of the seal-less pump is the simpler design of the pump. In addition, the process fluid itself can be used for cooling and lubricating components of the pump, e.g. the bearing units of the pump shaft and the drive unit of the pump.

According to a preferred configuration the pump comprises a first pump bearing unit and a second pump bearing unit for supporting the pump shaft, wherein the first pump bearing unit is arranged between the first balance drum and the drive unit, and configured to receive process fluid passing through the first relief passage or through the balance line, and wherein the second pump bearing unit is arranged between the second balance drum and the non-drive end or at the non-drive end, and configured to receive process fluid passing through the balance line or through the second relief passage. In some embodiments the first bearing unit at the drive end is configured for radially and axially supporting the pump shaft, and the second bearing unit at the non-drive end of the pump shaft is configured for radially supporting the pump shaft.

According to a preferred design the drive unit comprises a drive shaft, an electric motor configured for rotating the drive shaft about the axial direction, a first and a second motor bearing unit for supporting the drive shaft, wherein the drive shaft is connected to the drive end of the pump shaft, wherein the electric motor is arranged between the first motor bearing unit and the second motor bearing unit, and wherein the drive unit is configured to receive process fluid from the first pump bearing unit for at least lubricating the first and the second motor bearing unit.

In particular for this design it is preferred that the balance line is arranged and configured to receive process fluid discharged from the drive unit. Thus, the process fluid, e.g. passing through the first relief passage along the first balance drum to the first back side defined by the first balance drum is directed to the to the first pump bearing unit, passes the first pump bearing unit, is then guided to pass through the drive unit and subsequently enters the balance line.

According to another preferred embodiment the pump has an external cooling loop for cooling and lubricating the motor bearing units and the pump bearing units by means of the process fluid. The external cooling loop comprises a heat exchanger for cooling the process fluid, wherein the heat exchanger is arranged outside the common housing and configured to receive process fluid from the drive unit and to supply process fluid to the motor bearing units and/or the pump bearing units.

For moving the process fluid through the external cooling loop, a circulation impeller or a plurality of circulation impellers can be provided. The circulation impeller for the external cooling circuit is preferably rotated by the drive unit and can be arranged on top of the drive unit. The drive unit drives the circulation impeller, which circulates the process fluid through the heat exchanger and the bearing units. The heat exchanger can be a coil surrounding the common housing of the pump.

According to another design for the cooling and the lubrication, the pump unit comprises an intermediate take-off connected to a cooling loop, wherein the intermediate take-off supplies the process fluid to the cooling loop with a pressure that is larger than the pressure of the process fluid at the low pressure inlet, and wherein the cooling loop supplies process fluid to the motor bearing units and/or the pump bearing units. Thus, the pressure for circulating the process fluid through the motor and pump bearing units is taken from the pump unit itself by the intermediate take-off.

Regarding the embodiments having the first pump section and the second pump section it is a preferred configuration that—with respect to the axial direction—the increased pressure inlet is arranged between the high pressure outlet and the increased pressure outlet, and the low pressure inlet is arranged between the increased pressure inlet and the increased pressure outlet. This is one possible measure to ensure that the flow of the process fluid through the throttle device is directed from the first pump section to the second pump section.

In some embodiments the first set of impellers comprises a different number, in particular a larger number of impellers than the second set of impellers. This measure is particularly preferred when the first pump section is used as a water injection pump and the second pump section as a feed pump.

According to a preferred design, the first set of impellers and the second set of impellers are arranged in a back-to-back arrangement, so that an axial thrust generated by the first set of impellers is directed opposite to an axial thrust generated by the second set of impellers. The back-to-back design provides for at least a partial compensation of the axial thrusts created by the first set of impellers and the second set of impellers, respectively.

According to a preferred application the pump is configured for installation on a sea ground.

According to a preferred embodiment the pump is configured as a water injection pump for injecting seawater into a subterranean region.

In addition, according to the invention a seawater injection system is proposed comprising a membrane filtration unit for filtering the seawater and a process fluid lubricated pump for injecting the seawater into a subterranean region, wherein the process fluid lubricated pump is designed according to the invention with the first pump section. The process fluid is preferably seawater. The low pressure inlet of the pump is connected to an outlet of the membrane filtration unit to receive filtered seawater, and the high pressure outlet of the pump is in fluid communication with a well for injecting seawater into a subterranean region.

Furthermore, according to the invention a seawater injection system is proposed comprising a membrane filtration unit for filtering the seawater and a process fluid lubricated pump for injecting the seawater into a subterranean region, wherein the process fluid lubricated pump is designed according to the invention and with the first pump section and with the second pump section. The process fluid is preferably seawater. The low pressure inlet of the pump receives seawater. The increased pressure outlet is connected to an inlet of the membrane filtration unit to supply seawater to the membrane filtration unit. The increased pressure inlet of the pump is connected to an outlet of the membrane filter unit to receive filtered seawater. The high pressure outlet of the pump is in fluid communication with a well for injecting seawater into a subterranean region.

Preferably, the seawater injection system is configured for a deployment on the sea ground. The seawater injection system can be installed at a depth of down to 100 m, down to 500 m or even down to more than 1,000 m beneath the water surface.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
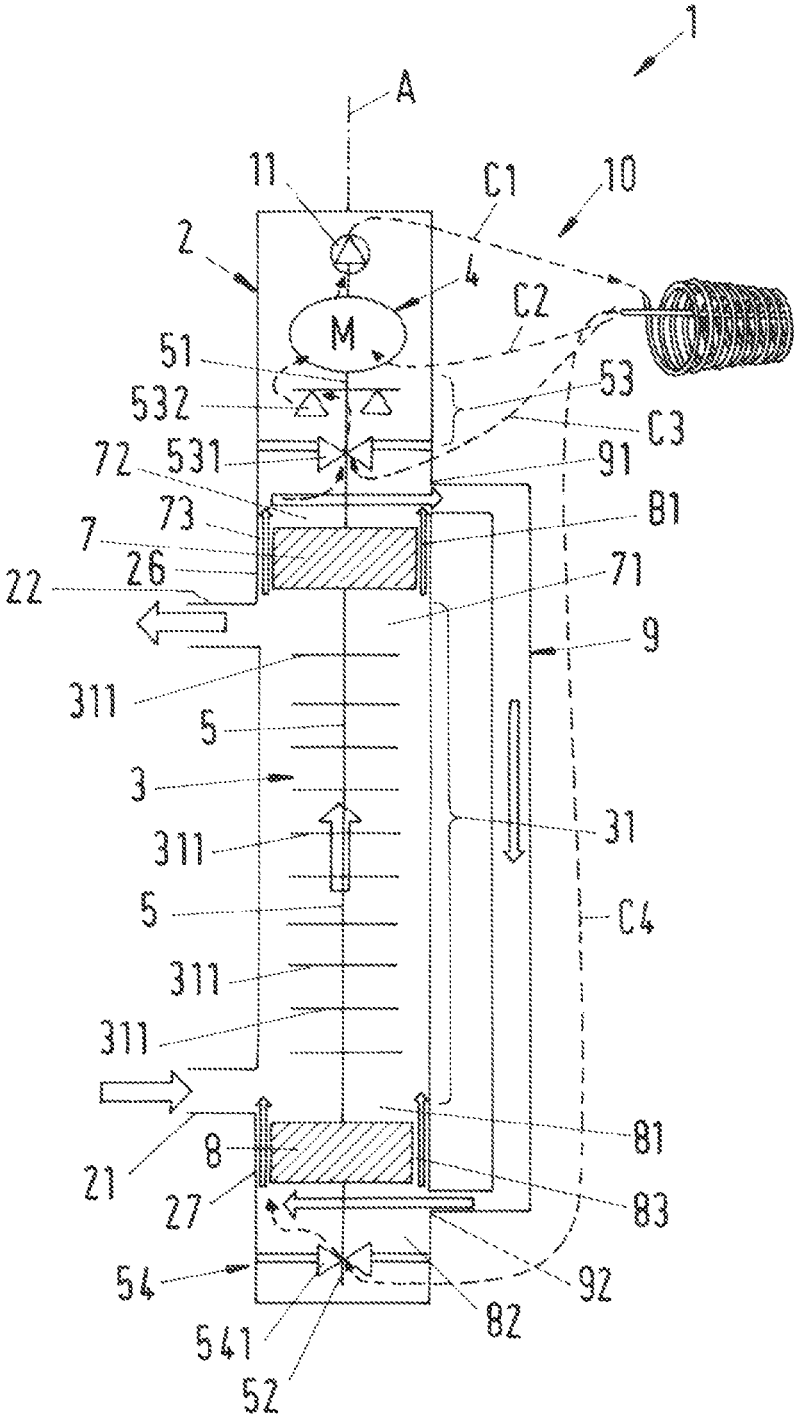
FIG. 1 is a schematic cross-sectional view of a first embodiment of a process fluid lubricated pump according to the invention.

FIG. 1 shows a schematic cross-sectional view of a first embodiment of a process fluid lubricated pump according to the invention, which is designated in its entity with reference numeral 1. The pump 1 is a centrifugal pump for conveying a process fluid and has a common housing 2, a pump unit (pump) 3 and a drive unit (drive) 4. Both the pump unit 3 and the drive unit 4 are arranged within the common housing 2. The common housing 2 is designed as a pressure housing, which is able to withstand the pressure generated by the pump 1 as well as the pressure exerted on the pump 1 by the environment. The common housing 2 can comprise several housing parts, e.g. a pump housing and a drive housing, which are connected to each other to form the common housing 2 surrounding the pump unit 3 and the drive unit 4.

In the following description reference is made by way of example to the important application that the process fluid lubricated pump 1 is designed and adapted for being used as a subsea water injection pump 1 in the oil and gas industry, in particular for injecting water into a subterranean oil and/or gas reservoir to increase recovery of hydrocarbons from the subterranean region. By injecting the water into the reservoir the hydrocarbons are forced to flow towards and out of the production well. Accordingly, the process fluid that is conveyed by the pump 1 is water and especially seawater. The process fluid lubricated pump 1 is in particular configured for installation on the sea ground, i.e. for use beneath the water surface, in particular down to a depth of 100 m, down to 500 m or even down to more than 1000 m beneath the water surface of the sea.

It goes without saying that the invention is not restricted to this specific example but is related to process fluid lubricated pumps in general. The invention can be used for many different applications, especially for such applications where the pump 1 is installed at locations, which are difficult to access. Preferably, the pump 1 according to the invention is designed as a water injection pump. Even if preferred, the pump 1 is not necessarily configured for deployment on the sea ground or for subsea applications, but can also be configured for top side applications, e.g. for an installation ashore or on an oil platform, in particular on an unmanned platform. In addition, the pump 1 according to the invention can also be used for applications outside the oil and gas industry.

The term "process fluid lubricated pump" refers to pumps, where the process fluid that is conveyed by the pump 1 is used for the lubrication and the cooling of components of the pump, e.g. bearing units. A process fluid lubricated pump 1 does not require a specific barrier fluid different from the process fluid to avoid leakage of the process fluid e.g. into the drive unit 4. In addition, a process fluid lubricated pump 1 does not require a lubricant different from the process fluid for the lubrication of the pump components. In the following description reference is made by way of example to the important application that the process fluid is water, in particular seawater. The term seawater comprises raw seawater, purified seawater, pretreated seawater, filtered seawater, in particular microfiltered seawater and nanofiltered seawater. Of course, the pump 1 according to the invention can also be configured for conveying other process fluids than water or seawater.

The common housing 2 of the pump 1 comprises a low pressure inlet 21, through which the process fluid enters the pump 1, and a high pressure outlet 22 for discharging the process fluid with an increased pressure as compared to the pressure of the process fluid at the low pressure inlet 21. Typically, the high pressure outlet 22 is connected to a pipe (not shown) for delivering the pressurized process fluid to a well, in which the process fluid is injected. The pressure of the process fluid at the high pressure outlet 22 is referred to as 'high pressure' whereas the pressure of the process fluid at the low pressure inlet 21 is referred to as 'low pressure'. A typical value for the difference between the high pressure and the low pressure is for example 100 to 200 bar (10-20 MPa).

The pump unit 3 further comprises a pump shaft 5 extending from a drive end 51 to a non-drive end 52 of the pump shaft 5. The pump shaft 5 is configured for rotating about an axial direction A, which is defined by the longitudinal axis of the pump shaft 5.

The pump unit 3 further comprises a first pump section 31 having a first set of impellers 311 fixedly mounted on the pump shaft 5 and configured for increasing the pressure of the pressure fluid from the low pressure to the high pressure. The first set of impellers 311 comprises a plurality of impellers 311 mounted in series on the pump shaft 5 in a torque proof manner. FIG. 1 shows an example where the first set of impellers 311 comprises ten impellers 311 arranged in series on the pump shaft 5.

The drive unit 4, which will be explained in more detail hereinafter, is configured to exert torque on the drive end 51 of the pump shaft 5 for driving the rotation of the pump shaft 5 and the impellers 311 about the axial direction A.

The process fluid lubricated pump 1 is a vertical pump 1, meaning that during operation the pump shaft 5 is extending in the vertical direction, which is the direction of gravity. Thus, the axial direction A coincides with the vertical direction.

A direction perpendicular to the axial direction is referred to as radial direction. The term 'axial' or 'axially' is used with the common meaning 'in axial direction' or 'with respect to the axial direction'. In an analogous manner the term 'radial' or 'radially' is used with the common meaning 'in radial direction' or 'with respect to the radial direction'. Hereinafter relative terms regarding the location like "above" or "below" or "upper" or "lower" or "top" or "bottom" refer to the usual operating position of the pump 1. FIG. 1, FIG. 5, FIG. 6 and FIG. 9 and FIGS. 10-12 show different embodiments and variants of the pump 1 in their respective usual operating position.

Referring to this usual orientation during operation and as shown in FIG. 1 the drive unit 4 is located above the pump unit 3. However, in other embodiments the pump unit 3 can be located on top of the drive unit 4.

The low pressure inlet 21 is arranged at the lower end of the pump unit 3, and the high pressure outlet 22 is located at the upper end of the pump unit 3.

The pump 1 comprises a first pump bearing unit (first pump bearing)53 and a second pump bearing unit (second pump bearing)54 for supporting the pump shaft 5. The first pump bearing unit 53, which is the upper one, is arranged adjacently to the drive end 51 of the pump shaft 5 between the pump unit 3 and the drive unit 4. The second pump bearing unit 54, which is the lower one, is arranged between the pump unit 3 and the non-drive end 52 of the pump shaft 5 or at the non-drive end 52. The pump bearing units 53, 54 are configured to support the pump shaft 5 both in axial and radial direction. In the embodiment shown in FIG. 1 the first pump bearing unit 53 comprises both an upper radial bearing 531 for supporting the pump shaft 5 with respect to the radial direction, and an axial bearing 532 for supporting the pump shaft 5 with respect to the axial direction A. The upper radial bearing 531 and the axial bearing 532 are arranged such that the axial bearing 532 is facing the drive unit 4 and the upper radial bearing 531 is facing the pump unit 3, i.e. the axial bearing 532 is arranged between the upper radial bearing 531 and the drive unit 4. Of course, it is also possible, to exchange the position of the upper radial bearing 531 and the axial bearing 532, i.e. to arrange the upper radial bearing 531 between the axial bearing 532 and the drive unit 4. Such an arrangement is e.g. shown in FIG. 4. In the arrangement the upper radial bearing 531 and the axial bearing 532 are arranged such that the upper radial bearing 531 is facing the drive unit 4 and the axial bearing 532 is facing the pump unit 3, i.e. the upper radial bearing 531 is arranged between the axial bearing 532 and the drive unit 4.

A radial bearing, such as the upper radial bearing 531 is also referred to as a "journal bearing" and an axial bearing, such as the axial bearing 532, is also referred to as an "thrust bearing". The upper radial bearing 531 and the axial bearing 532 can be separate bearings, but it is also possible that the upper radial bearing 531 and the axial bearing 532 are a single combined radial and axial bearing supporting the pump shaft 5 both in radial and in axial direction.

The second pump bearing unit 54 comprises a lower radial bearing 541 for supporting the pump shaft 5 in radial direction. In the embodiment shown in FIG. 1, the second pump bearing unit 54 comprises no axial or thrust bearing. Of course, it is also possible that the second pump bearing unit 54 comprises an axial bearing for the pump shaft 5. In embodiments, where the second pump bearing unit 54 at the non-drive end 52 comprises an axial bearing, the first pump bearing unit 53 at the drive end 51 can be configured without an axial bearing or with an axial bearing.

The pump 1 further comprises a first balance drum 7 and a second balance drum 8 for at least partially balancing the axial thrust that is generated by the impellers 311 during operation of the pump 1. Both balance drums 7, 8 are fixedly connected to the pump shaft 5. The first balance drum 7 is arranged above the upper end of the pump unit 3, namely between the pump unit 3 and the drive end 51 of the pump shaft 5, more precisely between the upper end of the pump unit 3 and the first pump bearing unit 53. The first balance drum 7 defines a first front side 71 and a first back side 72. The first front side 71 is the side facing the pump unit 3 and the first set of impellers 311. The first back side 72 is the side facing the first pump bearing unit 53 and the drive unit 4.

The first balance drum 7 is surrounded by a first stationary part 26, so that a first relief passage 73 is formed between the radially outer surface of the first balance drum 7 and the first stationary part 26. The first stationary part 26 is configured to be stationary with respect to the common housing 2. The first relief passage 73 forms an annular gap between the outer surface of the first balance drum 7 and the first stationary part 26 and extends from the first front side 71 to the first back side 72. The first front side 71 is in fluid communication with the high pressure outlet 22, so that the axial surface of the first balance drum 7 facing the first front side 71 is exposed essentially to the high pressure prevailing at the high pressure outlet 22 during operation of the pump 1. Of course, due to smaller pressure losses caused by the fluid communication between the high pressure outlet 22 and the first balance drum 7 the pressure prevailing at the axial surface of the first balance drum 1 facing the first front side 71 can be somewhat smaller than the high pressure. However, the considerably larger pressure drop takes place over the first balance drum 7. At the first back side 72 a first intermediate pressure prevails during operation of the pump 1. The first intermediate pressure has a value between the low pressure at the low pressure inlet 21 and the high pressure at the high pressure outlet 22, e.g. the first intermediate pressure is essentially midway between the low pressure and the high pressure.

Since the first front side 71 is exposed essentially to the high pressure at the high pressure outlet 22, a pressure drop exists over the first balance drum 7 resulting in a force that is directed upwardly in the axial direction A and therewith counteracts the downwardly directed axial thrust generated by the first set of impeller 311 during operation of the pump 1.

The second balance drum 8 is arranged below the lower end of the pump unit 3, namely between the pump unit 3 and the non-drive end 52 of the pump shaft 5, more precisely between the lower end of the pump unit 3 and the second pump bearing unit 54. The second balance drum 8 defines a second front side 81 and a second back side 82. The second front side 81 is the side facing the pump unit 3 and the first set of impellers 311. The second back side 82 is the side facing the second pump bearing unit 54. The second balance drum 8 is surrounded by a second stationary part 27, so that a second relief passage 83 is formed between the radially outer surface of the second balance drum 8 and the second stationary part 27. The second stationary part 27 is configured to be stationary with respect to the common housing 2. The second relief passage 83 forms an annular gap between the outer surface of the second balance drum 8 and the second stationary part 27 and extends from the second front side 81 to the second back side 82. The second front side 81 is in fluid communication with the low pressure inlet 21, so that the axial surface of the second balance drum 8 facing the second front side 81 is exposed essentially to the low pressure prevailing at the low pressure inlet 21 during operation of the pump 1.

A balance line 9 connects the first back side 72 and the second back side 82. The balance line 9 constitutes a flow connection between the first back side 72 and the second back side 82. The balance line 9 can be arranged outside the common housing 2 and extend from a first port 91 at the first back side 72 to a second port 92 at the second back side 82. The first and the second port 91, 92 are arranged at the common housing 2 in such a manner, that the first port 91 is in fluid communication with the first back side 72 and the second port 92 is in fluid communication with the second back side 82. Thus, during operation of the pump 1 the process fluid can flow from the first back side 72 to the second back side 82 through the balance line 9. Therefore, the pressure prevailing at the second back side 82 is essentially the same—apart from a minor pressure drop caused by the balance line 9—as the pressure prevailing at the first back side 72, namely the first intermediate pressure.

Since the second front side 81 is exposed to the low pressure at the low pressure inlet 21, a pressure drop exists over the second balance drum 8 resulting in a force that is directed upwardly in the axial direction A and therewith counteracts the downwardly directed axial thrust generated by the first set of impeller 311 during operation of the pump 1.

According to a preferred measure the first balance drum 7 and the first relief passage 73 are configured in the same manner as the second balance drum 8 and the second relief passage 83, so that the pressure drop over the first balance drum 7 is at least essentially the same as the pressure drop over the second balance drum 8. In such a configuration the first intermediate pressure equals half the sum of the low pressure and the high pressure.

The process fluid lubricated pump 1 is designed as a seal-less pump. A seal-less pump 1 is a pump that has no mechanical seals for the sealing of the rotating pump shaft 5. A mechanical seal is a seal for a rotating shaft comprising a rotor fixed to the shaft and rotating with the shaft as well as a stationary stator fixed with respect to the housing. During operation the rotor and the stator are sliding along each other—usually with a liquid there between—for providing a sealing action to prevent the process fluid from escaping to the environment or entering the drive of the pump. The seal-less pump 1 shown in FIG. 1 has no such mechanical seals. The process fluid is deliberately allowed to enter the drive unit 4 and is used for cooling and lubricating components of the pump 1 such as the pump bearing units 53, 54.

Figure 2:
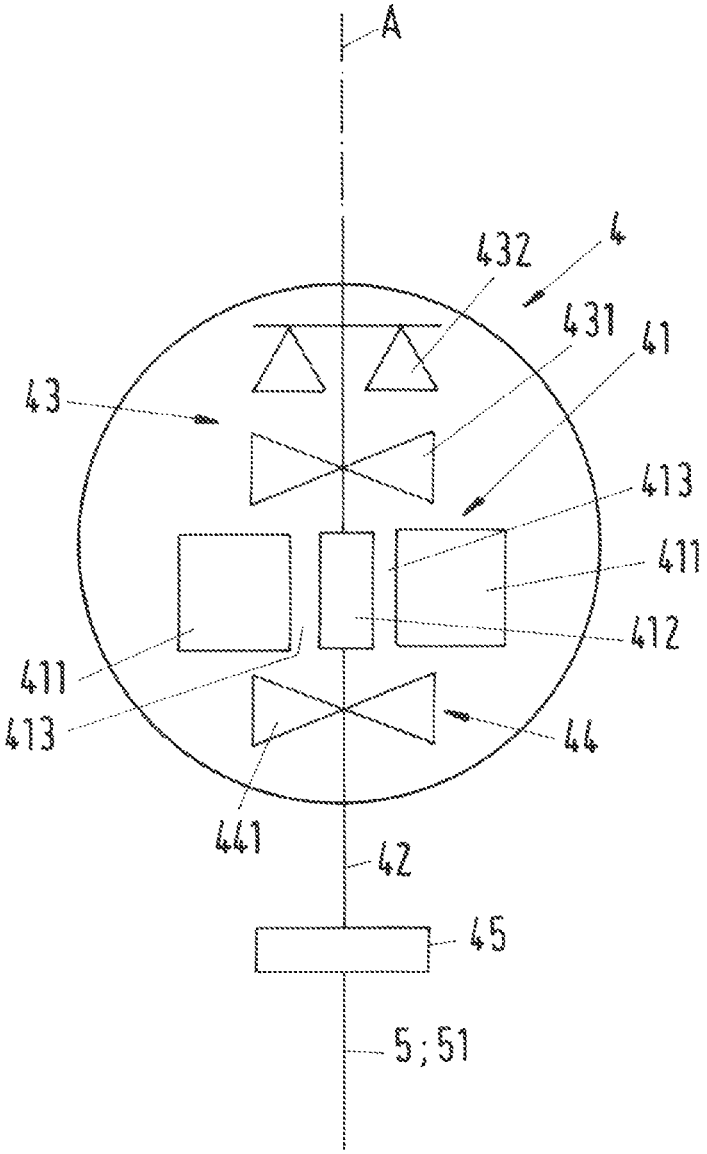
FIG. 2 is a schematic representation of an embodiment of the drive unit.

FIG. 2 shows a schematic representation of an embodiment of the drive unit 4 more in detail.

The drive unit 4 comprises an electric motor 41, a drive shaft 42 extending in the axial direction A, a first motor bearing unit (first motor bearing) 43 arranged above the electric motor 41 with respect to the axial direction A, and a second motor bearing unit (second motor bearing) 44 arranged below the electric motor 41. The electric motor 41, which is arranged between the first motor bearing unit 43 and the second motor bearing unit 44, is configured for rotating the drive shaft 42 about the axial direction A. The drive shaft 42 is connected to the drive end 51 of the pump shaft 5 by means of a coupling 45 for transferring a torque to the pump shaft 5. Preferably the coupling 45 is a flexible coupling 45, which connects the drive shaft 42 to the pump shaft 5 in a torque proof manner, but allows for a relative movement between the drive shaft 42 and the pump shaft 5, e.g. lateral movements. Thus, the flexible coupling 45 transfers the torque with no or nearly no lateral vibrations. The flexible coupling 45 can be configured as a mechanical coupling, a magnetic coupling, a hydrodynamic coupling or any other coupling that is suited to transfer a torque from the drive shaft 42 to the pump shaft 5.

The first motor bearing unit 43 and the second motor bearing unit 44 are support the drive shaft 42 both in radial direction and in the axial direction A. The first motor bearing unit 43 comprises both an upper radial bearing 431 for supporting the drive shaft 42 with respect to the radial direction, and an axial bearing 432 for supporting the drive shaft 42 with respect to the axial direction A. The upper radial bearing 431 and the axial bearing 432 are arranged such that the upper radial bearing 431 is arranged between the axial bearing 432 and the electric motor 41.

Of course, it is also possible, to exchange the position of the upper radial bearing 431 and the axial bearing 432, i.e. to arrange the upper radial bearing 431 above the axial bearing 432. In such a design the axial bearing 432 of the first motor bearing unit 43 is arranged between the upper radial bearing 431 and the electric motor 41.

The upper radial bearing 431 and the axial bearing 432 can be configured as separate bearings, but it is also possible that the upper radial bearing 431 and the axial bearing 432 are configured as a single combined radial and axial bearing supporting the drive shaft 42 both in radial and in axial direction A.

The second motor bearing unit 44 comprises a lower radial bearing 441 for supporting the drive shaft 42 in radial direction. In the embodiment shown in FIG. 2, the second motor bearing unit 44 comprises no axial or thrust bearing. Of course, it is also possible that the second motor bearing unit 44 comprises an axial bearing for the drive shaft 42. In embodiments, where the second motor bearing unit 44 comprises an axial bearing, the first motor bearing unit 43 can be configured without an axial bearing or with an axial bearing.

The electric motor 41 of the drive unit 4 comprises an inwardly disposed rotor 412, which is connected to the drive shaft 42 in a torque proof manner, as well as an outwardly disposed motor stator 411 surrounding the rotor 412 with an annular gap 413 between the rotor 412 and the motor stator 411. The rotor 412 can constitute a part of the drive shaft 42 or is a separate part, which is rotationally fixedly connected to the drive shaft 42, so that the rotation of the rotor 412 drivers the drive shaft 42. The electric motor 41 can be configured as a cable wound motor. In a cable wound motor the individual wires of the motor stator 411, which form the coils for generating the electromagnetic field(s), are each insulated, so that the motor stator 411 can be flooded even with an electrically conducting fluid, e.g. raw seawater. The cable wound motor does not require a dielectric fluid for cooling the motor stator 411. Alternatively, the electric motor 41 can be configured as a canned motor. When the electric drive 41 is configured as a canned motor, the annular gap 413 is radially outwardly delimited by a can (not shown) that seals the motor stator 411 hermetically with respect to the rotor 412 and the gap 413. Thus, any process fluid flowing through the gap 413 cannot enter the motor stator 411. When the electric motor 41 is designed as a canned motor a dielectric cooling fluid different from the process fluid, can be circulated through the hermetically sealed motor stator 411 for cooling the motor stator 411.

Preferably, the electric motor 41 is a permanent magnet motor or as an induction motor. To supply the electric motor 41 with energy, a power penetrator (not shown) is provided at the common housing 2 for receiving a power cable (not shown) that supplies the motor 41 with power.

The electric motor 41 can be designed to operate with a variable frequency drive (VFD), in which the speed of the drive, i.e. the frequency of the rotation is adjustable by varying the frequency and/or the voltage supplied to the electric motor 41. However, it is also possible that the electric motor 41 is configured differently, for example as a single speed or single frequency drive.

Figure 3:
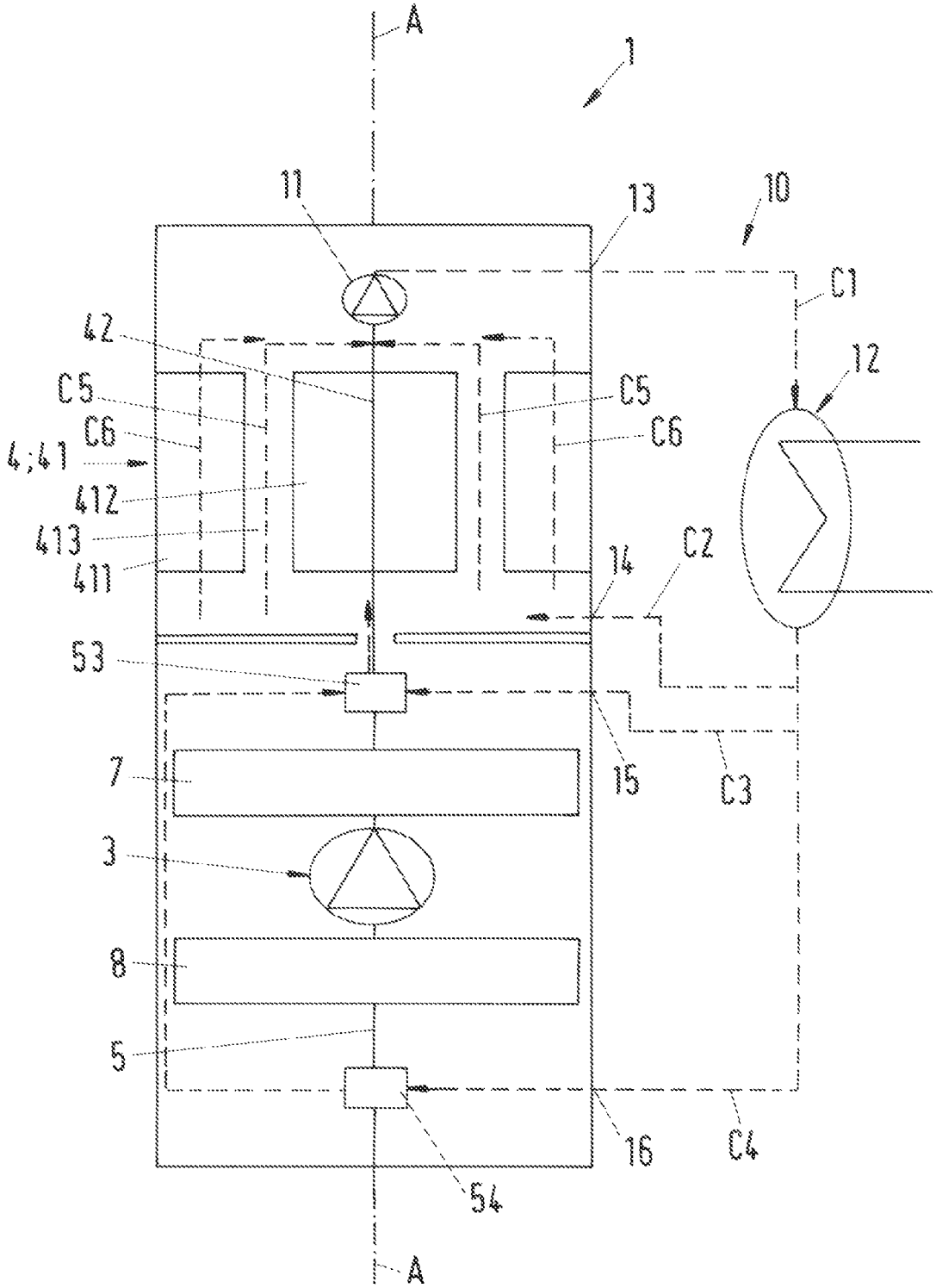
FIG. 3 is a schematic representation for illustrating an embodiment of an external cooling loop.

During operation, the pump 1 is cooled and lubricated by the process fluid, e.g. seawater. In the first embodiment, shown in FIG. 1, an external cooling loop 10 enhances the cooling of the pump 1. For a better understanding FIG. 3 shows a schematic representation of the pump 1 illustrating an embodiment of the external cooling loop 10. The external cooling loop 10 is also operated with the process fluid, e.g. seawater, as heat carrier. According to this embodiment, the external cooling loop 10 comprises at least one circulation impeller 11 for circulating the process fluid through the external cooling loop 10. The circulation impeller 11 is a different feature than the impellers 311 of the first set of impellers 311.

Since the process fluid constitutes the heat carrier, the external cooling loop 10 can be designed as an open circuit, which receives process fluid from the pump unit 3, and which delivers the process fluid to different locations of the pump 1. The circulation impeller 11 is driven by the electric motor 41 and preferably by the drive shaft 42. As shown in FIG. 1 and FIG. 3 the circulation impeller 11 can be arranged for example on top the electric motor 41, but other locations are also possible. For example, the circulation impeller(s) 11 can also be arranged at one or at more of the following locations: the non-drive end of the drive shaft 42, the drive end of the drive shaft 42, the drive end 51 of the pump shaft 5, above the first balance drum 7, above the first port 91 to the balance line 9, below the first pump bearing unit 53, above the first pump bearing unit 53, at the non-drive end 52 of the pump shaft 5, below the second pump bearing unit 54.

The external cooling loop 10 further comprises a heat exchanger 12 for cooling the process fluid in the external cooling loop 10. The heat exchanger 12 is located outside the common casing 2. Preferably, the heat exchanger 12 is designed as a coil or a spiral that surrounds the common casing 2. In a subsea application, the seawater around the pump 1 extracts heat from the coil-shaped heat exchanger 12 at the outside of the common housing 2 and therewith cools the process liquid in the external cooling loop 10. The flow of the process fluid in the external cooling loop 10 is indicated in FIG. 1 and in FIG. 3 with the dashed arrows. As can be best seen in FIG. 3 the heat exchanger 12 is in fluid communication with an exit 13 for receiving process fluid from the drive unit 4 as indicated by arrow C1. More precisely, the exit 13 is provided at the common housing 2 at a location above the drive unit 4, so that the heat exchanger 12 receives process fluid that has passed through the drive unit 4 and therewith cooled the drive unit 4. In the heat exchanger 12 the environment extracts heat from the process fluid and cools the process fluid. After having passed through the heat exchanger 12 the cooled process fluid is provided to several location of the pump for cooling and lubricating the components. For each location a respective entrance 14, 15, 16 (FIG. 3) for the process fluid is provided at the common housing 2. Downstream of the heat exchanger 12 a first part of the cooled process fluid, as indicated by arrow C2, is introduced through entrance 14 directly into the drive unit 4 for cooling and lubricating the motor bearing units 43 and 44 (not shown in FIG. 3) as well as for cooling the electric motor 41. A second part of the cooled process fluid, as indicated by arrow C3, is introduced through entrance 15 directly into the first pump bearing unit 53 for cooling and lubricating the first pump bearing unit 53. A third part of the cooled process fluid, as indicated by arrow C4, is introduced through entrance 16 directly into the second pump bearing unit 54 for cooling and lubricating the second pump bearing unit 54. The process fluid that passes through the electric motor 41 for cooling the electric motor is directed through the annular gap 413 as indicated by the dashed arrows C5 in FIG. 3. In case the motor stator 411 shall be flooded with the process fluid for cooling, e.g. when the electric motor is configured as a cable wound motor or when the process fluid is an insulating fluid such as filtered or nanofiltered seawater, the process fluid is also directed through the motor stator 411 as indicated by the dashed arrows C6 in FIG. 3.

Figure 4:
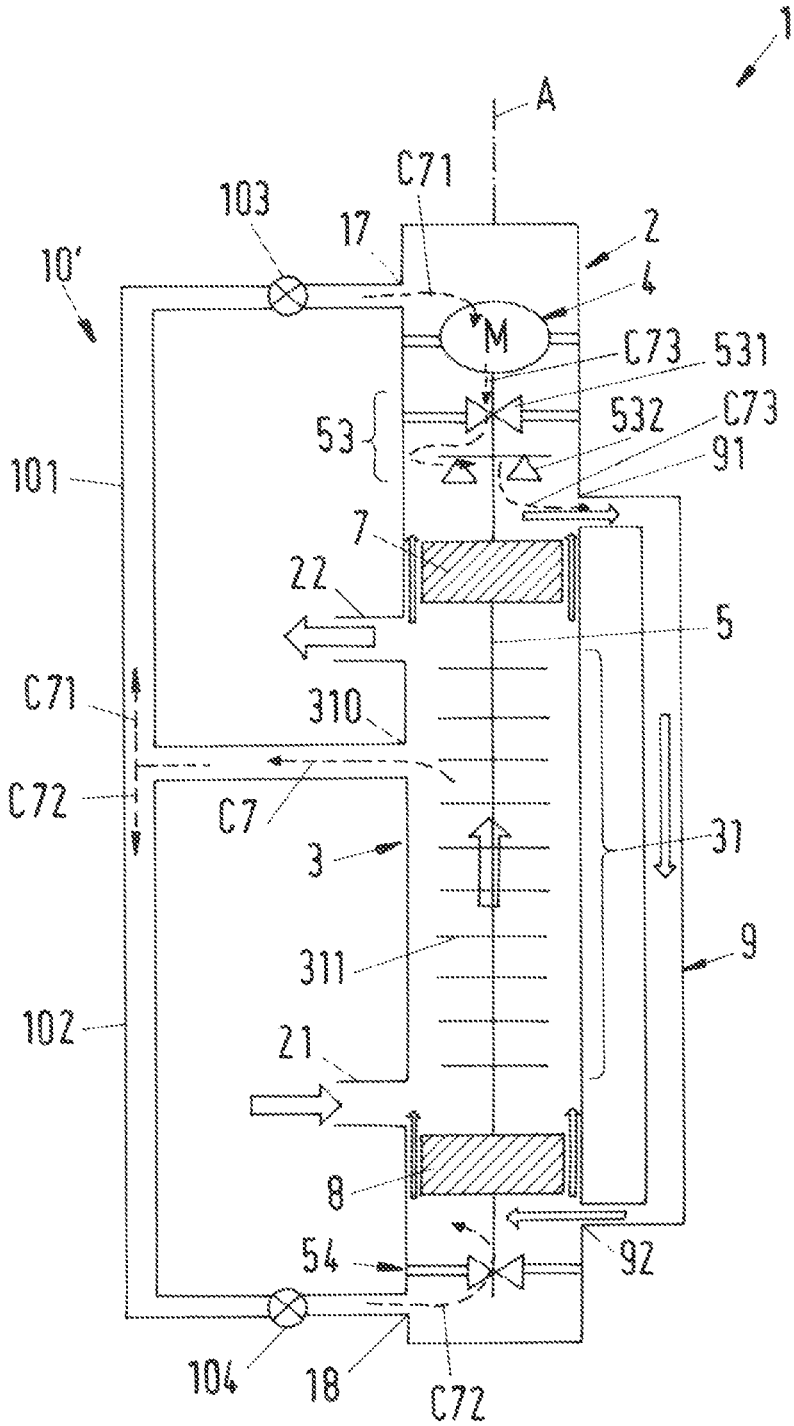
FIG. 4 is a schematic cross-sectional view of the first embodiment with another embodiment of a cooling loop.

FIG. 4 shows a different design for a cooling loop 10' in a cross-sectional view similar to FIG. 1. This design does not require the circulation impeller 11 but can also comprise a circulation impeller. In the configuration shown in FIG. 4 no circulation impeller is provided for. According to this design of the cooling loop 10', the pump unit 3 comprises an intermediate take-off 310 connected to the cooling loop 10' for supplying the process fluid to the cooling loop 10' as indicated by the dashed arrow C7 in FIG. 4. The intermediate take-off 310 is configured to supply the process fluid to the cooling loop 10' at a pressure which is larger than the low pressure at the low pressure inlet 21.

The cooling loop 10' comprises a first branch 101 enabling fluid communication between the intermediate take-off 310 and an entrance 17, through which the process fluid can enter the drive unit 4 for cooling and lubricating the drive unit 4 as indicated by the dashed arrows C71 in FIG. 4. The process fluid that has passed through the drive unit 4 is guided through the first pump bearing unit 53 for cooling and lubricating the first pump bearing unit 53 as indicated by the dashed arrows C73 in FIG. 4. The process fluid that passed through the first pump bearing unit 53 merges with the process fluid that passed along the first balance drum 7 and enters the balance line 9.

As already mentioned earlier, FIG. 4 shows a design of the first pumping unit 53, in which the upper radial bearing 531 and the axial bearing 532 are arranged such that the upper radial bearing 531 is facing the drive unit 4 and the axial bearing 532 is facing the pump unit 3, i.e. the upper radial bearing 531 is arranged between the axial bearing 532 and the drive unit 4.

Optionally the first branch 101 of the cooling loop 10' can comprise a first flow restrictor 103, e.g. a throttle, provided in the first branch 101 to regulate the flow of process fluid that it passing through the first pump bearing unit 53 and the drive unit 4.

The cooling loop 10' further comprises a second branch 102 providing a fluid communication between the intermediate take-off 310 and an entrance 18, through which the process fluid can enter the second pump bearing unit 54 for cooling and lubricating the second pump bearing unit 54 as indicated by the dashed arrows C72 in FIG. 4. When the process fluid has passed through the second pump bearing unit 54 it merges with the process fluid exiting the balance line 9.

Optionally the second branch 102 can comprise a second flow restrictor 104, e.g. a throttle, provided in the second branch 102 to regulate the flow of process fluid that it passing through the second pump bearing unit 53.

The intermediate take-off 310 can be arranged to receive the process fluid from one of the impellers 311 of the first set of impellers 311. Thus, according to the design shown in FIG. 4 the driving force for circulating the process fluid through the cooling loop 10' is generated by one or more of the impellers 311 of the pump unit 3. Preferably, the intermediate take-off 310 is configured such, that the pressure of the process fluid in the first and the second branch 101 and 102 is at least as large as the pressure of the process fluid in the balance line 9. Even more preferred, the pressure of the process fluid in the first and the second branch 101 and 102 of the cooling loop 10' is a few bar higher, for example 10-30 bar higher than the pressure in the balance line 9

The first and the second branch 101 and 102 of the cooling loop can be designed as internal lines completely extending within the common casing 2. It is also possible—as shown in FIG. 4—that the first and the second branch 101 and 102 are external lines arranged outside the common housing 2. It has to be noted that the cooling loop 10' can also comprise a heat exchanger in an analogous manner as explained for the heat exchanger 12 shown in FIG. 3.

The operation of the first embodiment of the pump 1 according to the invention will now be described referring to FIG. 1 to FIG. 3. The process fluid entering the pump 1 through the low pressure inlet 21 is pressurized by the action of the rotating first set of impellers 311 and leaves the pump 1 through the high pressure outlet 22 as indicated in FIG. 1 by the large solid line arrows without reference numeral. The first front side 71 below the first balance drum 7 is in fluid communication with the high pressure outlet 22. Therefore, a part of the pressurized process fluid passes through the first relief passage 73 to the first back side 72 as indicated by arrows B1 in FIG. 1. At the first back side 72 the first intermediate pressure prevails which is smaller than the high pressure due to the pressure drop over the first balance drum 7. Thus, a force is generated acting upon the pump shaft 5. The force is directed upwardly in axial direction A and therewith partially balancing the axial thrust that is generated by the first set of impellers 311 and that is directed downwardly in axial direction A. At the first back side 72 a part of the process fluid enters the balance line 9 through the first port 91, and another part enters the first pump bearing unit 53 and merges with the process fluid of the external cooling loop 10, which enters the first pump bearing unit 53 through the entrance 15 (FIG. 3).

The process fluid flowing through the balance line 9 enters the second back side 82 below the second balance drum 8 and merges with the process fluid that has been introduced from the external cooling loop 10 through entrance 16 (FIG. 3) into the second pump bearing unit 54.

The pressure prevailing at the second back side 82 is essentially the same as the pressure at the first back side 72, namely the first intermediate pressure. The balance line 9 causes a small pressure drop so that the pressure at the second back side 82 is somewhat smaller than the first intermediate pressure but this difference can be neglected for the understanding of the invention. The pressure at the second back side 82, namely the first intermediate pressure is larger than the low pressure at the low pressure inlet 21, so that the process fluid flows from the second back side 82 through the second relief passage 83 to the second front side 81. The pressure drop over the second balance drum 8 generates a force acting on the pump shaft 5. Said force is directed upwardly in axial direction A and therefore partially balances the axial thrust generated by the rotating impellers 311, which is directed downwardly in axial direction A.

Thus, the two balance drums 7 and 8, which are arranged in series from a hydrodynamic perspective at least partially compensate the axial thrust on the pump shaft 5 that is generated by the rotating impellers 311. Even if the balance drums 7 and 8 do not completely balance said axial thrust, the load that has to be carried by the axial bearing 532 of the first pump bearing unit 53, is considerably reduced. Providing a balance drum 7, 8 both at the drive end 51 and at the non-drive end 52 of the pump shaft 5 considerably increases the stability of the entire rotor device comprising the pump shaft 5, the first set of impellers 311 and the two balance drums 7 and 8. By the two balance drums 7, 8 a whirling of the lower part of the pump shaft 5, i.e. the part of the pump shaft 5 adjacent to the non-drive end 52 is reliably prevented or at least considerably reduced.

Only by way of example and for the better understanding the following different pressures can prevail at and in the pump 1: When, as an example, the pump 1 is deployed at the sea ground in a depth of 500 m below the water surface, the low pressure prevailing at the low pressure inlet 21 is e.g. 50 bar. The pump 1 can be configured to increase the pressure by 300 bar. Thus, the high pressure at the high pressure outlet 22 is 350 bar. When the first balance drum 7 and the first relief passage 73 are configured in the same manner as the second balance drum 8 and the second relief passage 83, the pressure drop over the first balance drum 7 is at least approximately the same as the pressure drop over the second balance drum 8, namely in each case roughly 150 bar, when neglecting other minor pressure losses such as the pressure losses in the balance line 9. Accordingly, the first intermediated pressure prevailing both at the first back side 72 and at the second back side 82 is about 200 bar.

The cooling and the lubricating of the pump 1 by the process fluid is achieved both by the flow through the balance line 9, which is driven by the action of the first set of impellers 311 and indicated by the arrows in solid lines in FIG. 1, and by the flow through the external cooling loop 10 indicated by the arrows in dashed lines. Both said flows contribute to cool and lubricate the pump bearing units 53 and 54, the motor bearing units 43 and 44 as well as the electric motor 41 with the process fluid.

Figure 5:
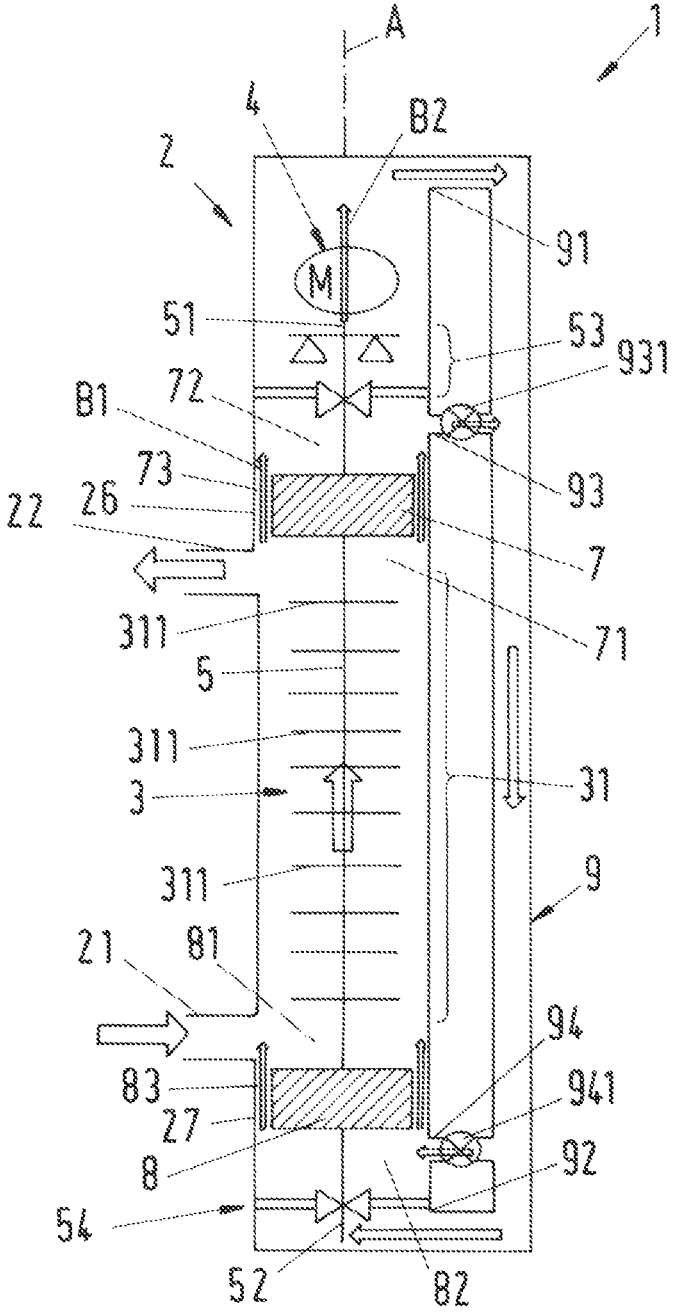
FIG. 5 is a schematic cross-sectional view of a second embodiment of a process fluid lubricated pump according to the invention.

FIG. 5 shows a schematic cross-sectional view of a second embodiment of a process fluid lubricated pump 1 according to the invention.

In the following description of the second embodiment of the process fluid lubricated pump 1 only the differences to the first embodiment are explained in more detail. The explanations with respect to the first embodiment are also valid in the same way or in analogously the same way for the second embodiment. Same reference numerals designate the same features that have been explained with reference to the first embodiment or functionally equivalent features. In particular, the drive unit explained with reference to FIG. 2 can also be used for the second embodiment.

Compared to the first embodiment, it is the main difference, that the second embodiment of the pump 1 does not comprise an external cooling loop 10. The pump bearing units 53 and 54 as well as the drive unit 4 comprising the electric motor 41 and the motor bearing units 43 and 44 are only cooled and lubricated by the flow of process fluid, which is driven by the action of the first set of impellers 311 of the pump unit 3.

The first port 91, to which the balance line 9 is connected for receiving the process fluid, is arranged above the drive unit 4. The process fluid passing along the first balance drum 7 through the first relief passage 73 flows through the first pump bearing unit 53 and then enters the drive unit 4, passes through the second motor bearing unit 44, the electric motor 41, the first motor bearing unit 43 and leaves the drive unit 4 at the upper end of the drive unit 4 as indicated by the arrow B2 in FIG. 5. Above the drive unit 4 the first port 91 is located forming the entrance to the balance line 9. Thus, the balance line 9 receives the process fluid that is discharged from the drive unit 4. Channeling the process fluid through the first pump bearing unit 53 and the drive unit 4 results in a pressure drop between the first back side 72 and the first port 91. The pressure drop can be a few bar, e.g. about 10 bar. Thus, at the first port 91 prevails a second intermediate pressure, which is somewhat smaller than the first intermediate pressure prevailing at the first backside 72 between the first balance drum 7 and the first pump bearing unit 53.

The second port 92, to which the balance line 9 is connected, is arranged below the second pump bearing unit 54 at the non-drive end 52 of the pump shaft 5. Thus, the process fluid exiting the balance line 9 and passing through the second port 92 is guided to pass through the second pump bearing unit 54 to the second back side 82 at the second balance drum 8 From the second back side 82 the process fluid flows through the second relief passage 83 along the second balance drum 8 to the second front side 81, where the low pressure prevails. Since the process fluid is directed from the second port 92 through the second pump bearing unit 54, the pressure prevailing at the second back side 82 is somewhat smaller than the pressure at the second port 92. Neglecting the pressure drop over the balance line 9 from the first port 91 to the second port 92, the pressure at the second port 92 is the same as the pressure at the first port 91, namely the second intermediate pressure. Due to the pressure drop over the second pump bearing unit 54, there is a third intermediate pressure at the second back side 82, which is somewhat smaller, e.g. 4 bar smaller than the second intermediate pressure.

Optionally, there can be one or more bypass lines configured to limit the flow of process fluid through the different bearing units 53, 54, 43, 44. In FIG. 5 a first bypass line 93 is shown, which is configured to bypass the first pump bearing unit 53 as well as the drive unit 4. A first throttle 931 is provided in the first bypass line 93 to regulate the flow of process fluid that it passing through the first pump bearing unit 53 and the drive unit 4. Thus, a first part of the process fluid exiting the first relief passage 73 flows through the first pump bearing unit 53 and the drive unit 4 and then via the first port 91 into the balance line 9, and a second part of the process fluid exiting the first relief passage 73 bypasses both the first pump bearing unit 53 and the drive unit 4 and directly enters the balance line 9. In FIG. 5, the first bypass line 93 is shown as an external line. The entrance to the first bypass line 93 is located at the common housing 2 at a location between the first balance drum 7 and the first pump bearing unit 53 (regarding the axial direction A). From the entrance the first bypass line 93 extends towards the balance line 9 and opens out into the balance line 9. However, it is also possible and for many applications even preferred, that the first bypass line 93 is an internal line, which is completely located inside the common housing 2. For this purpose, the first bypass line 93 can be configured to constitute a direct flow communication between the first back side 72 and the first port 91, or the volume above the drive unit 4, respectively, wherein said flow communication bypasses the first pump bearing unit 53 and the drive unit 4. Configuring the first bypass line 93 as an internal line has the advantage that the number of openings required at the common housing 2 can be reduced.

Optionally, a second bypass line 94 can be provided, which is configured to bypass the second pump bearing unit 54 at the non-drive end 52 of the pump shaft 5. A second throttle 941 is provided in the second bypass line 94 to regulate the flow of process fluid that it passing through the second pump bearing unit 54. Thus, a first part of the process fluid flowing through the balance line 9 flows through the second pump bearing unit 54 to the second backside 82, and a second part of the process fluid flowing through the balance line 9 bypasses the second pump bearing unit 54 and directly enters the second back side 82 for being discharged through the second relief passage 83. In FIG. 5, the second bypass line 94 is shown as an external line connecting the balance line 9 with the second back side 82. The entrance to the second bypass line 94 is located at the balance line 9.

From there the second bypass line 94 extends towards the common housing 2 and is connected to an opening at the common housing, which opening is located between the second balance drum 8 and the second pump bearing unit 54 (regarding the axial direction A). However, it is also possible and for many applications even preferred, that the second bypass line 94 is configured as an internal line, which is completely located inside the common housing 2. For this purpose, the second bypass line 94 can be configured to constitute a direct flow communication between the second port 92 or the volume below the second pump bearing unit 54, respectively, and the second back side 82, wherein said flow communication bypasses the second pump bearing unit 54. Configuring the second bypass line 94 as an internal line has the advantage that the number of openings required at the common housing 2 can be reduced.

Reverting to the numerical example that has been given with reference to the first embodiment of the pump, the following different pressures can prevail at and in the second embodiment of the pump 1: When, as an example, the pump 1 is deployed at the sea ground in a depth of 500 m below the water surface, the low pressure prevailing at the low pressure inlet 21 is e.g. 50 bar. The pump 1 can be configured to increase the pressure by 195 bar. Thus, the high pressure at the high pressure outlet 22 is 245 bar. When the first balance drum 7 and the first relief passage 73 are configured in the same manner as the second balance drum 8 and the second relief passage 83, the pressure drop over the first balance drum 7 is at least approximately the same as the pressure drop over the second balance drum 8. Taking into consideration that there is also a pressure drop over the first pump bearing unit 53 and the drive unit 4 as well as over the second pump bearing unit 54, the respective pressure drop over each balance drum 7, 8 is less than half the pressure increase generated by the pump 1. For example, the pressure drop over each balance drum 7, 8 can be 90 bar, the pressure drop over the first pump bearing unit 53 and the drive unit 4 can be 10 bar and the pressure drop over the second pump bearing unit 54 can be 5 bar. Accordingly, the first intermediated pressure prevailing at the first back side 72 is about 155 bar. The second intermediate pressure above the drive unit 4 and below the second bearing unit 54, i.e. the pressure at the first port 91, the second port 92 and within the balance line 9, is approximately 145 bar. The third intermediate pressure prevailing at the second back side 82 is approximately 140 bar. The pressure at the second front side 81 is the low pressure of 50 bar.

Figure 6:
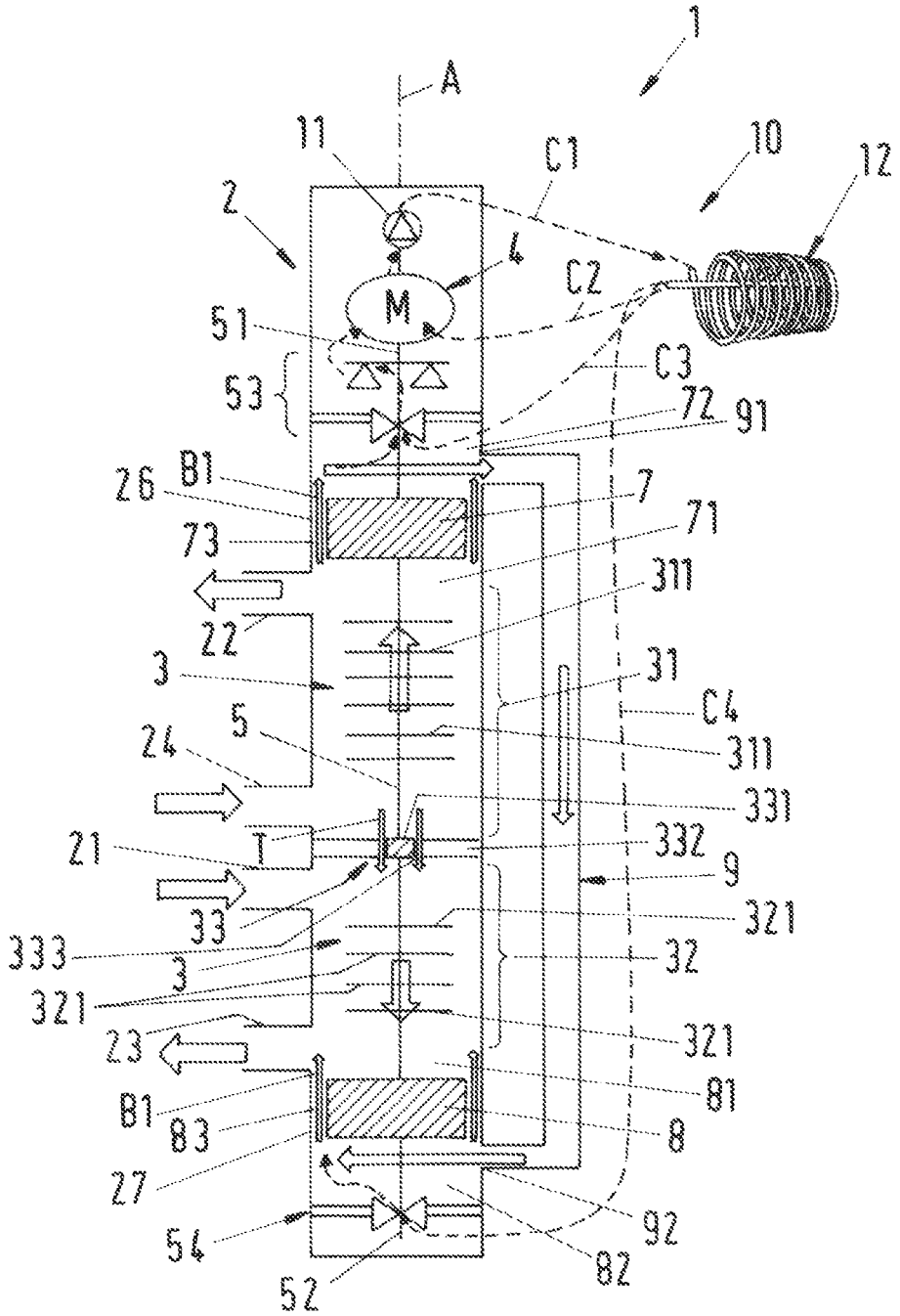
FIG. 6 is a schematic cross-sectional view of a third embodiment of a process fluid lubricated pump according to the invention.

FIG. 6 shows a schematic cross-sectional view of a third embodiment of a process fluid lubricated pump 1 according to the invention.

In the following description of the third embodiment of the process fluid lubricated pump 1 only the differences to the first and the second embodiment are explained in more detail. The explanations with respect to the first embodiment and with respect to the second embodiment are also valid in the same way or in analogously the same way for the third embodiment. Same reference numerals designate the same features that have been explained with reference to the first and the second embodiment or functionally equivalent features. In particular, the drive unit explained with reference to FIG. 2 can also be used for the third embodiment, and the external cooling loop 10 (FIG. 3) as well as the cooling loop 10' (FIG. 4) can also be used for the third embodiment.

Compared to the first and the second embodiment, it is the main difference, that the pump unit 3 of the third embodiment of the pump 1 comprises a second pump section 32 having a second set of impellers 321 fixedly mounted on the pump shaft 5 in a torque proof manner and configured to increase the pressure of the process fluid. The first pump section 31 and the second pump section 32 are arranged one after another with respect to the axial direction A. A throttling device 33 is arranged between the first pump section 31 and the second pump section 32 for restricting a fluid communication between the first pump section 31 and the second pump section 32 along the pump shaft 5. The throttling device 33 allows for a leakage of the process fluid from the first pump section 31 to the second pump section 32 as will be explained more in detail hereinafter. The throttling device 33 can comprise a center bush 331 fixedly connected to the pump shaft 5 and rotating with the pump shaft 5. The center bush 331 is surrounded by a stationary throttle part 332 being stationary with respect to the common housing 2. Thus, an annular throttle gap 333 is formed between the outer surface of the center bush 331 and the stationary throttle part 332. The process fluid can pass from the first pump section 31 through the throttle gap 333 of the throttling device 33 to the second pump section 32 as indicated by the small arrows with the reference numeral T. Due to the center bush 331 the throttling devices 33 additionally provides an axial force on the pump shaft 5, which counteracts the axial thrust generated by the first set of impellers 311 and/or the second set of impellers 321.

The common housing 2 further comprises an increased pressure outlet 23 and an increased pressure inlet 24. The second pump section 32 is in fluid communication with the low pressure inlet 21 and the increased pressure outlet 23. More precisely, the second pump section 32 is configured to receive the process fluid from the low pressure inlet 21, to increase the pressure of the process fluid and to discharge the pressurized process fluid through the increased pressure outlet 23. The first pump section 31 is in fluid communication with the increased pressure inlet 24 and the high pressure outlet 22. More precisely, the first pump section 31 is configured to receive the process fluid from the increased pressure inlet 24, to increase the pressure of the process fluid and to discharge the pressurized process fluid through the high pressure outlet 22.

According to the third embodiment, the pump unit 3 comprises two pump sections 31, 32 on the same pump shaft 5 and driven by the same drive unit 4. This "two-in-one" design basically functions like two pumps. The first pump section 31 can be used for a first pumping application and the second pump section 32 can be used for a second and different pump application. According to an application that is important in practice, the second pump section 32 can be used as a feed pump for providing seawater as process fluid to a membrane filtration unit 130 (FIG. 14) and the first pump section 31 can be used as a water injection pump receiving the nanofiltered process fluid from the membrane filtration unit 130 and discharging the pressurized process fluid through the high pressure outlet 22 to a well for injecting the seawater into a subterranean region.

In the third embodiment, the configuration with the first balance drum 7, the second balance drum 8 and the balance line 9 is basically the same as it has been described hereinbefore. The drive unit 4 can be designed in the same manner as it has been explained referring to FIG. 2. The third embodiment comprises the external cooling loop 10. The external cooling loop 10 can be configured in the same manner or in an analogous manner as it has been explained for the first embodiment referring to FIG. 1 and FIG. 3 or FIG. 4.

The first pump section 31 comprising the first set of impellers 311 and the second pump section 32 comprising the second set of impellers 321 can be arranged in an inline arrangement or in a back-to-back arrangement.

In an inline arrangement the first set of impellers 311 and the second set of impellers 321 are configured such that the axial thrust generated by the action of the rotating first set of impellers 311 is directed in the same direction as the axial thrust generated by the action of the rotating second set of impellers 321. Thus, the flow of process fluid from the low pressure inlet 21 to the increased pressure outlet 23, which is generated by the second set of impellers 321, is directed in the same direction as the flow of process fluid from the increased pressure inlet 24 to the high pressure outlet 22, which is generated by the first set of impellers 311.

In a back-to-back arrangement the first set of impellers 311 and the second set of impellers 321 are configured such that the axial thrust generated by the action of the rotating first set of impellers 311 is directed in the opposite direction as the axial thrust generated by the action of the rotating second set of impellers 321. Thus, the flow of process fluid from the low pressure inlet 21 to the increased pressure outlet 23, which is generated by the second set of impellers 321, is directed in the opposite direction as the flow of process fluid from the increased pressure inlet 24 to the high pressure outlet 22, which is generated by the first set of impellers 311.

For many applications the back-to-back arrangement is preferred because the axial thrust acting on the pump shaft 5, which is generated by the first set of impellers 311 counteracts the axial thrust, which is generated by the second set of impellers 321. Thus, said two axial thrusts compensate each other at least partially.

The back-to-back arrangement can be configured as shown e.g. in FIG. 6 with the high pressure outlet 22 and the increased pressure outlet 23 respectively arranged at one end of the pump unit 3 and both the low pressure inlet 21 and the increased pressure inlet 24 arranged between the outlets 22 and 23.

Figure 10:
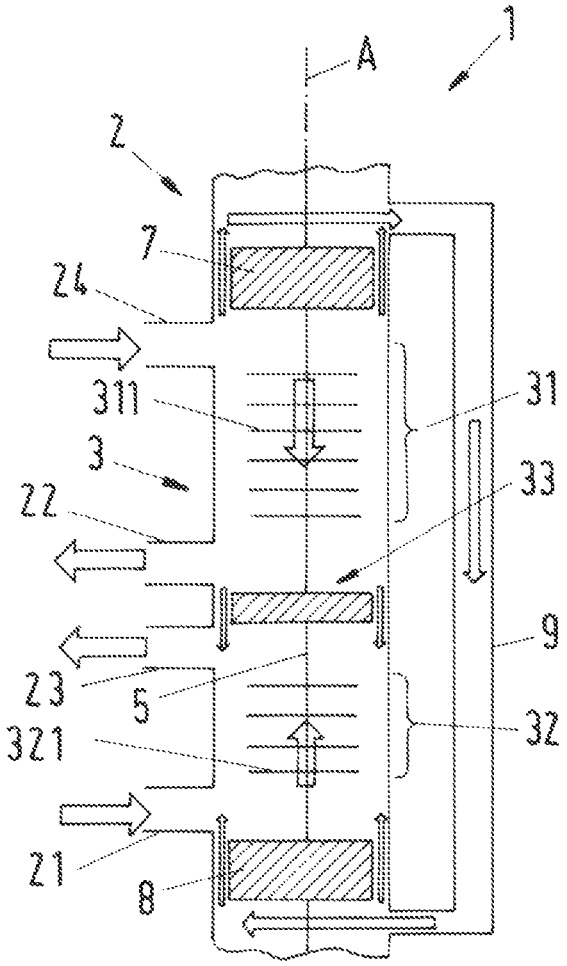
FIGS. 10-12 are schematic cross-sectional representations of different variants for the third and the fourth embodiment of the process fluid lubricated pump according to the invention.

According to another back-to-back arrangement shown for example in FIG. 10, the low pressure inlet 21 and the increased pressure inlet 24 are respectively arranged at one end of the pump unit 3 and both the increased pressure outlet 23 and the high pressure outlet 22 are arranged between the inlets 21 and 24.

However, it has to be noted that for other applications the inline arrangement can be used or even preferred.

Both for an inline arrangement and for a back-to-back arrangement the number of individual impellers 311 forming the first set of impellers 311 and the number of individual impellers 321 forming the second set of impellers 321 can be different or can be the same. It depends on the respective application, whether the first set and the second set have the same number of impellers 311 and 321, respectively, or whether the first set of impellers 311 has a different number of impellers 311 than the second set of impellers 321.

For many applications, in particular when the first pump section 31 functions as a water injection pump and the second pump section 32 functions as a feed pump, it is preferred, that the first set of impellers 311 comprises a larger number of impellers 311 than the second set of impellers 321. The reason is, that the pressure increase required from the first pump section 31 for the water injection is in many applications considerably larger than the pressure increase required from the second pump section 32 for feeding e.g. a membrane filtration unit. In the third embodiment of the pump 1 shown in FIG. 6 the first set of impellers 311 has six impellers 311 and the second set of impellers 321 has four impellers 321. That means, the first pump section 31 is configured as a six stage pump and the second pump section 32 is configured as a four stage pump.

The third embodiment of the pump 1 is configured with a back-to-back arrangement of the first set of impellers 311 and the second set of impellers 321. As it is shown in FIG. 6, the increased pressure inlet 24 is arranged between the high pressure outlet 22 and the increased pressure outlet 23. Furthermore, the low pressure inlet 21 is arranged between the increased pressure inlet 24 and the increased pressure outlet 23. Thus, going from top to down of the pump 1 along the axial direction A, the inlets 21, 24 and the outlets 22, 23 are arranged in the following sequence: high pressure outlet 22, increased pressure inlet 24, low pressure inlet 21, increased pressure outlet 23.

Thus, the high pressure outlet 22 is arranged next to the first balance drum 7, so that the first front side 71 is in fluid communication with the high pressure outlet 22. Therefore, the pressure at the first front side 71 is at least approximately the same as the high pressure.

The increased pressure outlet 23 is arranged next to the second balance drum 8, so that the second front side 81 is in fluid communication with the increased pressure outlet 23. Therefore, the pressure at the second front side 81 is at least approximately the same as the pressure at the increased pressure outlet 23.

The low pressure inlet 21 and the increased pressure inlet 24 are arranged adjacent to each other regarding the axial direction A. The throttling device 33 is arranged between the low pressure inlet 21 and the increased pressure inlet 24 so that at one side of the throttling device 33 the pressure at the low pressure inlet 21 prevails, i.e. the low pressure, and at the other side of the throttling device 33 the pressure at the increased pressure inlet 24 prevails. Thus, the throttling device 33 is exposed to the pressure difference between the pressures at the increased pressure inlet 24 and the low pressure at the low pressure inlet 21.

In many applications the pressure at the increased pressure inlet 24 is larger than the low pressure at the low pressure inlet 21, so that the process fluid can only flow through the throttling device 33 from the first pump section 31 to the second pump section 32, but not the other way around, i.e. from the second pump section 32 to the first pump section 31. The flow through the throttling device 33 is indicated by the small arrows with the reference numeral T.

Referring to the exemplary application that the first pump section 31 is used as a water injection pump and the second pump section 32 is used as a feed pump for feeding the membrane filtration unit 130 (FIG. 14) the low pressure inlet 21 can receive pre-filtered or microfiltered seawater as process fluid. The seawater is pressurized by the second pump section 32 to a pressure that is sufficient to feed the membrane filtration unit 130 and discharged through the increased pressure outlet 23. The increased pressure outlet 23 is in fluid communication with an inlet of the membrane filtration unit 130, e.g. by a piping. The membrane filtration unit 130 has typically two outlets, namely a permeate outlet and a concentrate outlet. The fluid that passed through the membrane of the membrane filtration unit 130 reaches the permeate outlet. This fluid is the nanofiltered seawater. The reminder of the process fluid, which does not pass through the membrane is also referred to as the concentrate. The concentrate reaches the concentrate outlet and is discharged from the membrane filtration unit.

The permeate outlet of the membrane unit 130 is in fluid communication with the increased pressure inlet 24 of the pump 1, e.g. by a piping, for delivering the nanofiltered seawater to the first pump section 31 of the pump 1. The first pump section 31 pressurizes the nanofiltered seawater and discharges the seawater through the high pressure outlet 22 for being injected into a well that leads to the subterranean region.

Only by way of example and for a better understanding the following numerical example is given regarding the different pressures at and in the pump 1: When, as an example, the pump 1 is deployed at the sea ground in a depth of 1000 m below the water surface, the low pressure prevailing at the low pressure inlet 21 is e.g. 100 bar. The second pump section 32 of the pump 1 can be configured to increase the pressure by 25 bar. Thus, the pressure at the increased pressure outlet 23 is 125 bar. From the increased pressure outlet 23 the process fluid is fed to the membrane filtration unit 130. The permeate outlet of the membrane filtration unit is connected to the increased pressure inlet 24 of the pump. The nanofiltered seawater has a pressure of 105 bar at the increased pressure inlet 24. Thus, the pressure drop over the throttling device is about 5 bar, so that the process fluid can pass through the throttling device 33 only from the first pump section 31 to the second pump section 32. The first pump section 31 can be configured to increase the pressure of the nanofiltered seawater by 195 bar. Thus, the high pressure at the high pressure outlet 22 is 300 bar. Accordingly, the pressure difference between the first front side 71 and the second front side 81 is 175 bar. When the first balance drum 7 and the first relief passage 73 are configured in the same manner as the second balance drum 8 and the second relief passage 83, the pressure drop over the first balance drum 7 is at least approximately the same as the pressure drop over the second balance drum 8, namely in each case 87.5 bar (neglecting the pressure drop over the balance line 9). Thus, the first intermediated pressure prevailing both at the first back side 72 and at the second back side 82 is about 212.5 bar.

It is an important advantage, that the process fluid, i.e. the seawater can pass through the throttling device 33 only in one direction, namely from the first pump section 31 to the second pump section 32, because the pressure of the nanofiltered seawater at the increased pressure inlet 24 is larger than the low pressure of the pre-filtered or microfiltered seawater at the low pressure inlet 21. Therefore it is reliably prevented that the less filtered seawater in the second pump section 32 contaminates the nanofiltered seawater in the first pump section 31.

Regarding the throttling device 33, which restricts the flow of process fluid between the first pump section 31 and the second pump section 32 along the pump shaft 5, several different designs are possible. Basically, the throttle device 33 can be configured for generating an additional thrust acting upon the pump shaft 5, or the throttling device 33 can be designed such, that it does not generated an additional thrust acting on the pump shaft 5. In case the throttle device shall generate an additional thrust on the pump shaft, the throttle device can comprise the center bush 331 fixedly connected to the pump shaft 5 as shown in FIG. 6 or a throttle sleeve that is fixedly connected to the pump shaft 5.

Figure 7:
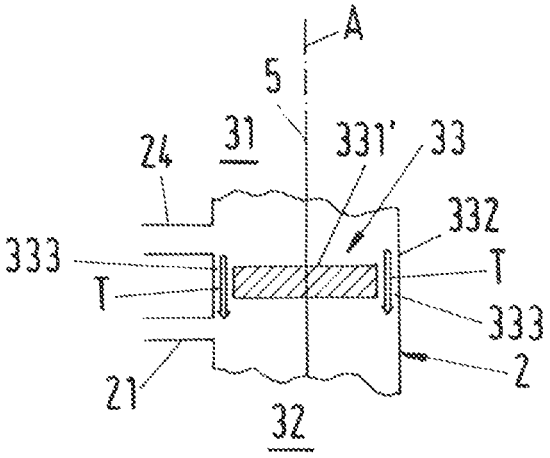
FIG. 7 is a schematic cross-sectional view of a first variant for the throttling device.

It is also possible to configure the throttling device 33 with a third balance drum 331' as it is shown as a first variant for the throttling device 33 in FIG. 7. In the same way as it has been explained with respect to the first and the second balance drum 7, 8, the third balance drum 331' is fixedly connected to the pump shaft 5 for co-rotating with the pump shaft 5. The third balance drum 331' is surrounded by the stationary throttle part 332 being stationary with respect to the common housing 2. Thus, the annular throttle gap 333 is formed between the outer surface of the third balance drum 331' and the stationary throttle part 332. The process fluid can pass from the first pump section 31 through the throttle gap 333 of the throttling device 33 to the second pump section 32 as indicated by the small arrows with the reference numeral T. The basic function of the third balance drum 331' is at least similar as the basic function of the center bush 331. Due to the different pressures acting on the axial surfaces of the balance drum 311' a thrust is generated, which acts upon the pump shaft. Usually, if the part fixedly connected to the pump shaft 5 has a smaller diameter (FIG. 6) it is referred to as a center bush 311 or a throttle sleeve, and if said part has a larger diameter it is referred to as a balance drum 311'.

Figure 14:
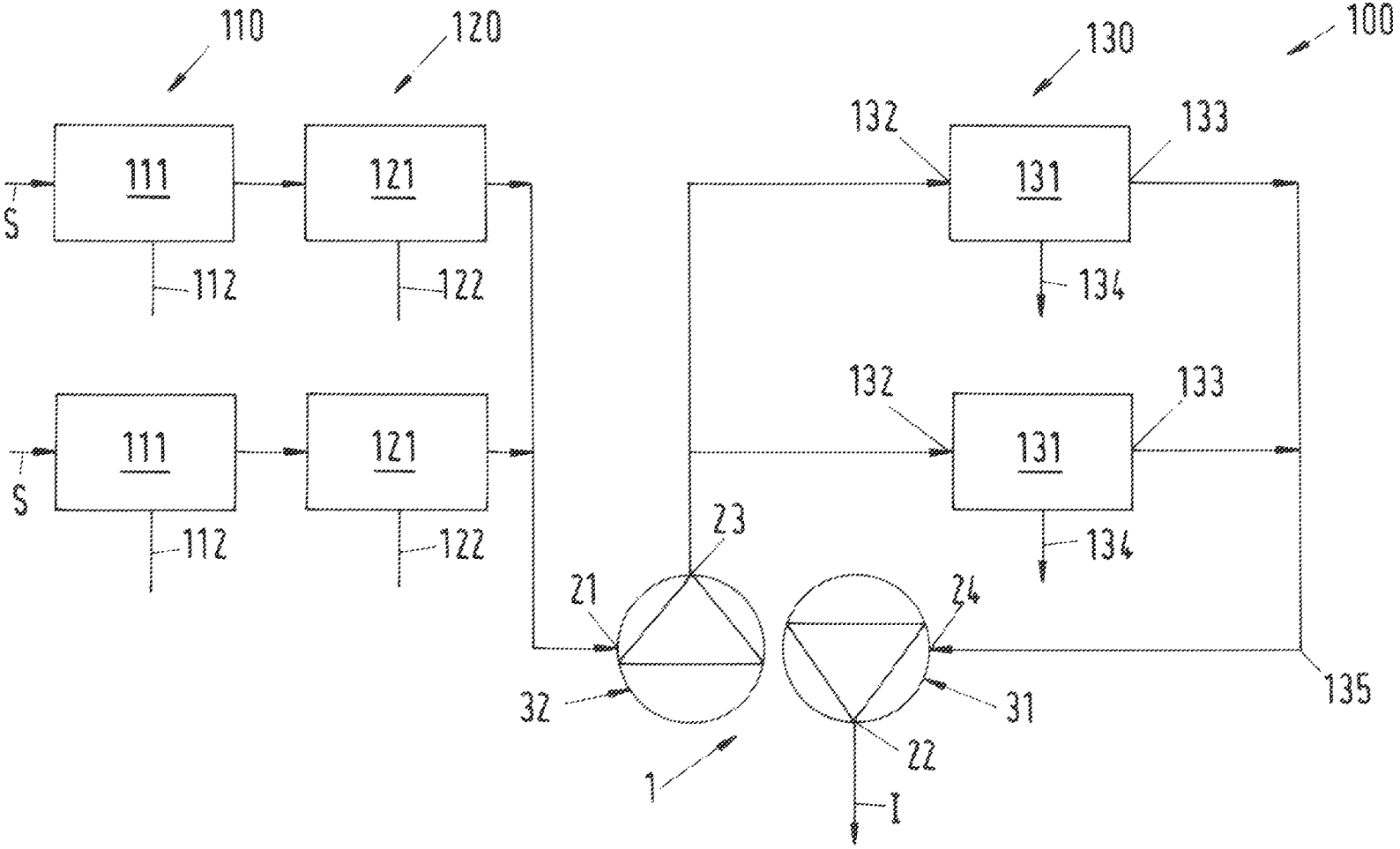
FIG. 14 is a schematic representation of a second embodiment of a seawater injection system according to the invention.

In particular when the throttling device 33 is designed with the third balance drum 331' there is usually a considerable pressure drop over the throttling device 33. Only by way of example and for a better understanding the following numerical example is given regarding the different pressures at and in the pump 1: When, as an example, the pump 1 is deployed at the sea ground in a depth of 1000 m below the water surface, the low pressure prevailing at the low pressure inlet 21 is e.g. 100 bar. The second pump section 32 of the pump 1 can be configured to increase the pressure by 80 bar. Thus, the pressure at the increased pressure outlet 23 is 180 bar. From the increased pressure outlet 23 the process fluid is fed to the membrane filtration unit 130 (FIG. 14). The permeate outlet of the membrane filtration unit 130 is connected to the increased pressure inlet 24 of the pump. The nanofiltered seawater has a pressure of 130 bar at the increased pressure inlet 24. Thus, the pressure drop over the throttling device is 30 bar. The first pump section 31 can increase the pressure of the nanofiltered seawater by 170 bar. Thus, the high pressure at the high pressure outlet 22 is 300 bar. Accordingly, the pressure difference between the first front side 71 and the second front side 81 is 120 bar. When the first balance drum 7 and the first relief passage 73 are configured in the same manner as the second balance drum 8 and the second relief passage 83, the pressure drop over the first balance drum 7 is at least approximately the same as the pressure drop over the second balance drum 8, namely in each case 60 bar (neglecting the pressure drop over the balance line 9). Thus, the first intermediated pressure prevailing both at the first back side 72 and at the second back side 82 is about 240 bar.

Figure 8:
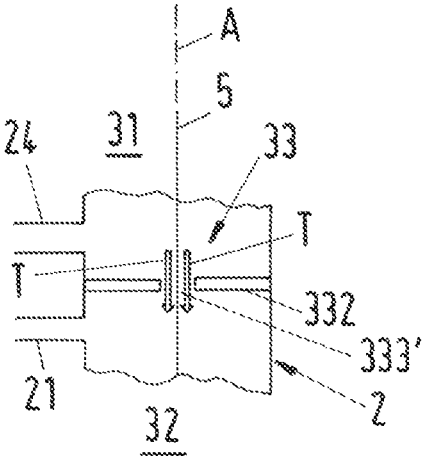
FIG. 8 is a schematic cross-sectional view of a second variant for the throttling device.

FIG. 8 shows in a schematic cross-sectional view a second variant for the throttling device 33. The second variant is configured such, that it does not generate an additional thrust acting on the pump shaft 5. The throttling device 33 comprises an annular throttling opening 333' surrounding the pump shaft 5 directly adjacent to the pump shaft 5. The annular throttling opening 333' is surrounded by the stationary throttle part 332 being stationary with respect to the common housing 2. Thus, the annular throttle opening 333' is formed between and delimited by the outer surface of the pump shaft 5 and the stationary throttle part 332.

Figure 9:
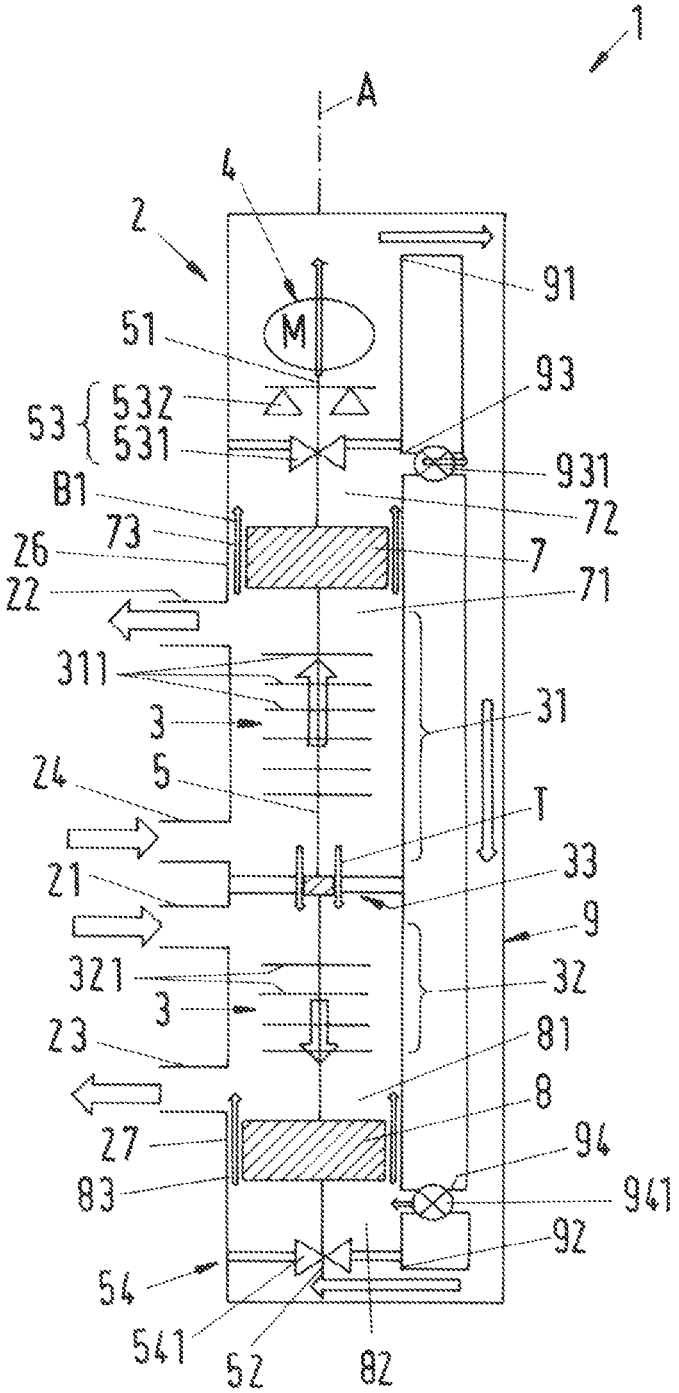
FIG. 9 is a schematic cross-sectional view of a fourth embodiment of a process fluid lubricated pump according to the invention.

FIG. 9 shows a schematic cross-sectional view of a fourth embodiment of a process fluid lubricated pump 1 according to the invention.

In the following description of the fourth embodiment of the process fluid lubricated pump 1 only the differences to the first, the second and the third embodiment are explained in more detail. The explanations with respect to the first embodiment, the second embodiment and the third embodiment are also valid in the same way or in analogously the same way for the fourth embodiment. Same reference numerals designate the same features that have been explained with reference to the first, the second and/or the third embodiment or functionally equivalent features. In particular, the drive unit explained with reference to FIG. 2 can also be used for the fourth embodiment.

The fourth embodiment of the pump 1 also comprises the second pump section 32 having the second set of impellers 321 fixedly mounted on the pump shaft 5 in a torque proof manner and configured to increase the pressure of the process fluid. Compared to the third embodiment, it is the main difference, that the fourth embodiment of the pump 1 does not comprise the external cooling loop 10. The pump bearing units 53 and 54 as well as the drive unit 4 comprising the electric motor 41 and the motor bearing units 43 and 44 are only cooled and lubricated by the flow of process fluid, which is driven by the action of the first set of impellers 311 and the second set of impellers 321 of the pump unit 3. Thus, the fourth embodiment is basically a combination of the two-in-one pump design explained with the help of the third embodiment and the design without external cooling loop as it has been explained with the help of the second embodiment. The cooling and the lubrication of the fourth embodiment of the pump 1 can be configured in the same way or in analogously the same way as it has been explained with respect to the second embodiment.

Figure 11:
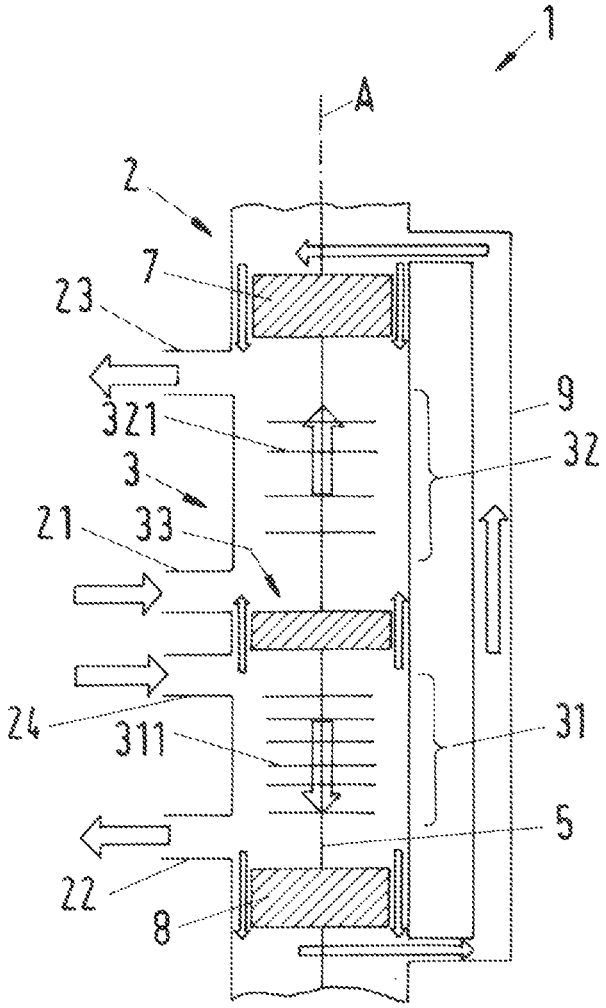
Figure 12:
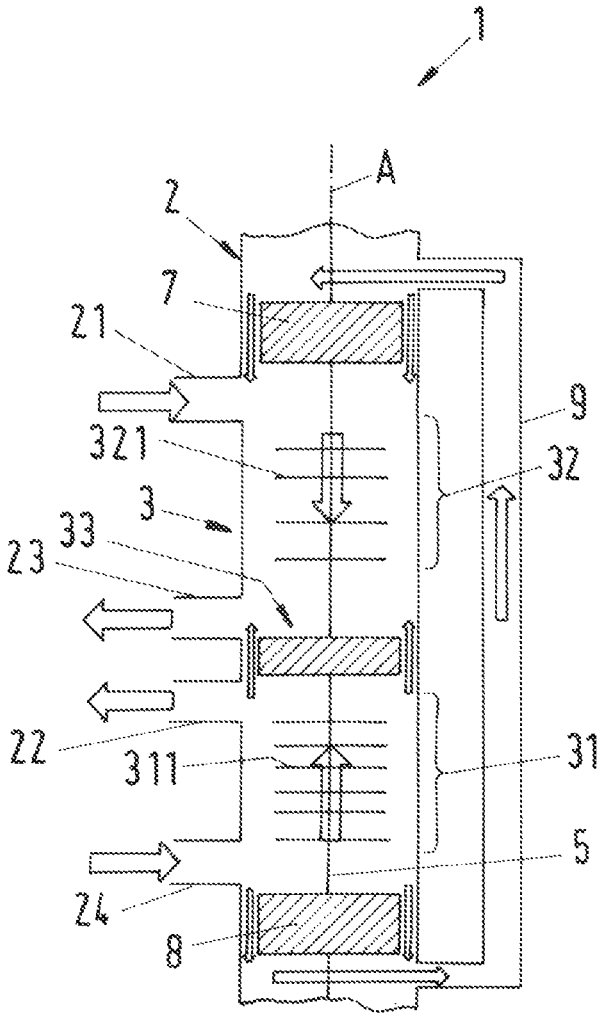

In FIG. 10, FIG. 11 and FIG. 12 different variants are shown for the third and the fourth embodiment in a schematic cross-sectional representation. Since all these variants are applicable both to the third embodiment (FIG. 6) having an external cooling loop 10 and to the fourth embodiment (FIG. 9) having no external cooling loop, in each of FIG. 10, FIG. 11 and FIG. 12 only the pump section 3 with the first and the second balance drum 7, 8 and the balance line 9 is shown.

FIG. 10 shows a variant in which the outlets 22, 23 are arranged between the inlets 21, 24 of the common casing 2. The increased pressure inlet 24 is arranged at the upper end of the pump unit 3 and next to the first balance drum 7, so that the first front side 71 is in fluid communication with the increased pressure inlet 24. Therefore, the pressure at the first front side 71 is at least approximately the same as the pressure at the increased pressure inlet 24. The low pressure inlet 21 is arranged at the lower end of the pump unit 3 and next to the second balance drum 8, so that the second front side 81 is in fluid communication with the low pressure inlet 21. Therefore, the pressure at the second front side 81 is at least approximately the same as the pressure at the low pressure inlet 21, namely the low pressure. The increased pressure outlet 23 and the high pressure outlet 22 are arranged adjacent to each other regarding the axial direction A. The throttling device 33 is arranged between the increased pressure outlet 23 and the high pressure outlet 22, so that at one side of the throttling device 33 the pressure at the increased pressure outlet 23 prevails, and at the other side of the throttling device 33 the pressure at the high pressure outlet 22 prevails, i.e. the high pressure. Thus, the throttling device 33 is exposed to the pressure difference between the pressures at the high pressure outlet 22 and the increased pressure outlet 23.

Thus, going from top to down of the pump 1 along the axial direction A, the inlets 21, 24 and the outlets 22, 23 are arranged in the following sequence: increased pressure inlet 24, high pressure outlet 22, increased pressure outlet 23, low pressure inlet 21.

According to the variants shown in FIG. 11 and FIG. 12, the second pump section 32 having the second set of impellers 312 is arranged on top of the first pump section 31 having the first set of impellers 311, i.e. the second pump section 32 is arranged with respect to the axial direction A between the first pump section 31 and the drive unit 4. In applications, where the first pump sections 31 is used as a water injection pump and the second pump section 32 is used as a (membrane) feed pump, the feed pump is arranged on top of the water injection pump and next to the drive unit 4.

According to the variant shown in FIG. 11 the inlets 21, 24 are arranged between the outlets 22, 23 of the common casing 2. The increased pressure outlet 23 is arranged at the upper end of the pump unit 3 and next to the first balance drum 7, so that the first front side 71 is in fluid communication with the increased pressure outlet 23. Therefore, the pressure at the first front side 71 is at least approximately the same as the pressure at the increased pressure outlet 23. The high pressure outlet 22 is arranged at the lower end of the pump unit 3 and next to the second balance drum 8, so that the second front side 81 is in fluid communication with the high pressure outlet 22. Therefore, the pressure at the second front side 81 is at least approximately the same as the pressure at the high pressure outlet 22, namely the high pressure. The increased pressure inlet 24 and the low pressure inlet 21 are arranged adjacent to each other regarding the axial direction A. The throttling device 33 is arranged between the increased pressure inlet 23 and the low pressure inlet 21, so that at one side of the throttling device 33 the pressure at the increased pressure inlet 23 prevails, and at the other side of the throttling device 33 the pressure at the low pressure inlet 21 prevails, i.e. the low pressure. Thus, the throttling device 33 is exposed to the pressure difference between the pressures at the increased pressure inlet 24 and the low pressure inlet 23.

Thus, going from top to down of the pump 1 along the axial direction A, the inlets 21, 24 and the outlets 22, 23 are arranged in the following sequence: increased pressure outlet 23, low pressure inlet 21, increased pressure inlet 24, high pressure outlet 22. The flow through the balance line 9 is directed in upward direction.

FIG. 12 shows a variant in which the outlets 22, 23 are arranged between the inlets 21, 24 of the common casing 2. The low pressure inlet 21 is arranged at the upper end of the pump unit 3 and next to the first balance drum 7, so that the first front side 71 is in fluid communication with the low pressure inlet 21. Therefore, the pressure at the first front side 71 is at least approximately the same as the pressure at the low pressure inlet 21, namely the low pressure. The increased pressure inlet 24 is arranged at the lower end of the pump unit 3 and next to the second balance drum 8, so that the second front side 81 is in fluid communication with the increased pressure inlet 24. Therefore, the pressure at the second front side 81 is at least approximately the same as the pressure at the increased pressure inlet 24. The increased pressure outlet 23 and the high pressure outlet 22 are arranged adjacent to each other regarding the axial direction A. The throttling device 33 is arranged between the increased pressure outlet 23 and the high pressure outlet 22, so that at one side of the throttling device 33 the pressure at the increased pressure outlet 24 prevails, and at the other side of the throttling device 33 the pressure at the high pressure outlet 22 prevails, i.e. the high pressure. Thus, the throttling device 33 is exposed to the pressure difference between the pressures at the high pressure outlet 22 and the increased pressure outlet 23.

Thus, going from top to down of the pump 1 along the axial direction A, the inlets 21, 24 and the outlets 22, 23 are arranged in the following sequence: low pressure inlet 21, increased pressure outlet 23, high pressure outlet 22, increased pressure inlet 24. The flow through the balance line 9 is directed in upward direction.

Figure 13:
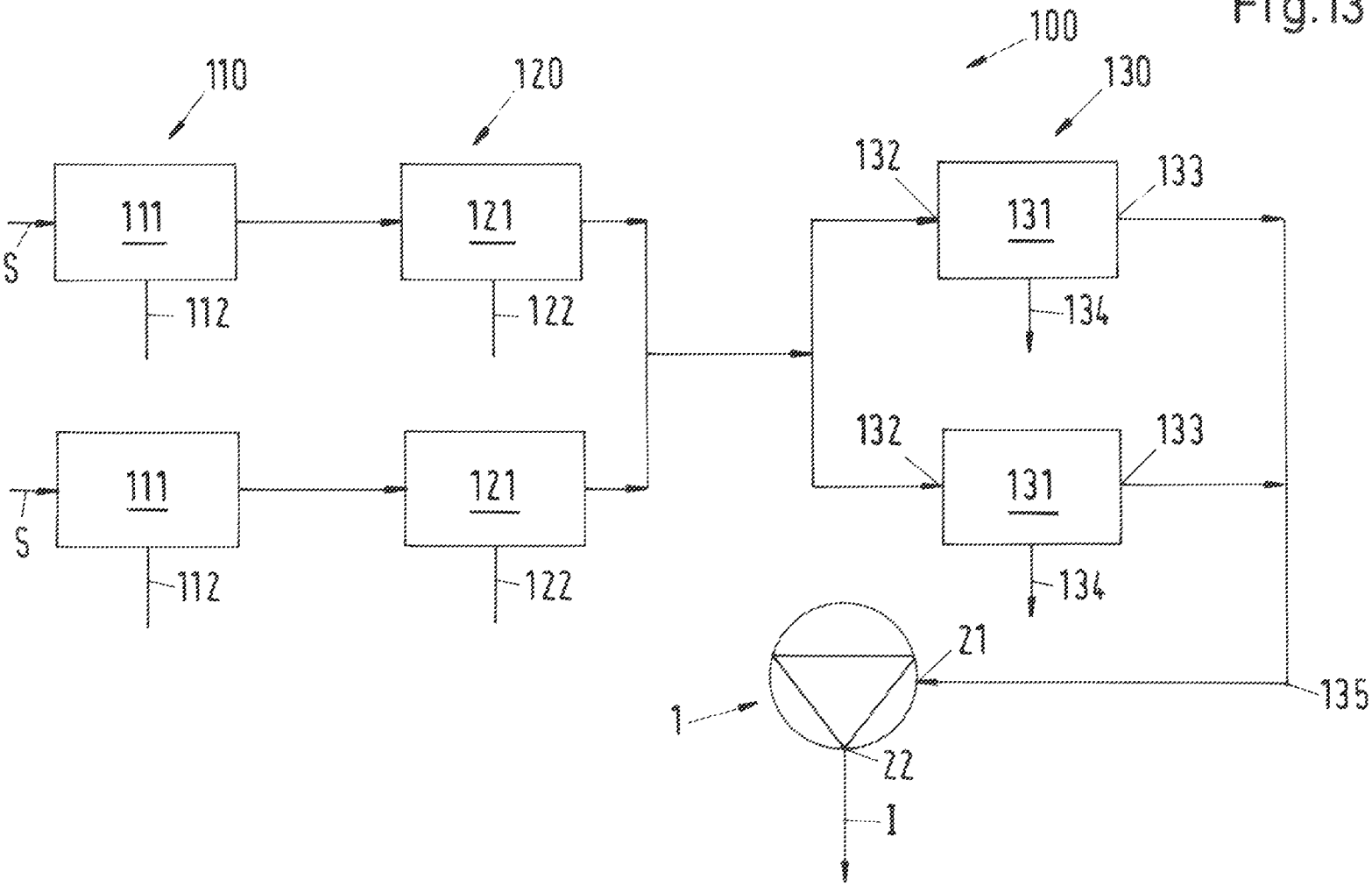
FIG. 13 is a schematic representation of a first embodiment of a seawater injection system according to the invention.

The process fluid lubricated pump 1 according to the invention is particularly suited as a water injection pump in seawater injection systems, especially in such systems, which are deployed on the sea ground. FIG. 13 shows a schematic representation of a first embodiment of a seawater injection system according to the invention, which is designated in its entity with reference numeral 100. The seawater injection system 100 provides seawater of sufficient purity for being injected into an oil and/or gas reservoir (not shown). The seawater injection system 100 comprises a coarse filtration unit 110, a microfiltration unit 120, a membrane filtration unit 130 and a process fluid lubricated pump 1, which is designed according to the invention.

The first embodiment of the seawater injection system is configured particularly for applications, where the hydrostatic pressure of the seawater is sufficient for operating the membrane filtration unit 130. Typically, the membranes in the membrane filtration unit 130 require a feed pressure of e.g. 20-50 bar (2-5 MPa), for example in applications where the membrane filtration unit 130 is configured as a sulfate removal unit. Depending on the specific application, the required feed pressure for the membrane filtration unit 130 can even be higher, e.g. if the membrane filtration unit 130 comprises a reverse osmosis device the required feed pressure can be up to 80 bar (8 MPa) or even higher. If, for example, the seawater injection system 100 is installed at a depth of 1100 m below the water surface, the hydrostatic pressure of the seawater is approximately 110 bar (11 MPa). This pressure is usually sufficient to operate the membrane filtration unit 130 without a feed pump even if considering that the coarse filtration unit 110 and the microfiltration unit 120 also cause a pressure drop for moving the seawater through these units 110, 120.

The coarse filtration unit 110 receives the seawater as indicated by the arrows S in FIG. 13. The seawater is passed through the coarse filtration unit 110 for removing larger sized particles and material. Optionally, for preparing the seawater for the further treatment, the coarse filtration unit 110 can also be configured to perform electro-chemical processes and/or biological processes by means of bactericides. The coarse filtration unit 110 can comprise a plurality of coarse filtration devices 111 being arranged in parallel. FIG. 13 shows two coarse filtration devices 111 arranged in parallel. Of course, it is also possible to configure the coarse filtration unit 110 with three or even more coarse filtration devices 111. Providing a plurality of coarse filtration devices 111 arranged in parallel has the advantage that one of the coarse filtration devices 111 can be taken offline, while the remaining coarse filtration devices 111 remain online and provide the seawater to the microfiltration unit 120 Each of the coarse filtration devices 111 can be provided with a backwash entrance 112 for backwashing the respective coarse filtration device 111.

After the process fluid, namely the seawater, has passed the coarse filtration unit 110 it is supplied to the microfiltration unit 120 for a finer filtration, i.e. for removing smaller sized particles. The microfiltration unit 120 can comprise a plurality of microfiltration devices 121 arranged in parallel. FIG. 13 shows two microfiltration devices 121 arranged in parallel. Of course, it is also possible to configure the microfiltration unit 120 with three or even more microfiltration devices 121. Providing a plurality of microfiltration devices 121 arranged in parallel has the advantage that one of the microfiltration devices 121 can be taken offline, while the remaining microfiltration devices 121 remain online and provide the seawater to the membrane filtration unit 130. Each of the microfiltration devices 121 can be provided with a backwash entrance 122 for backwashing the respective microfiltration device 121.

After the seawater has passed the microfiltration unit 120, the microfiltered seawater is supplied to the membrane filtration unit 130 for a nanofiltration, e.g. for removing sulfates or other sub-micron particles from the seawater. The membrane filtration unit 130 can comprise a plurality of nanofiltration devices 131 arranged in parallel. FIG. 13 shows two nanofiltration devices 131 arranged in parallel. Of course, it is also possible to configure the membrane filtration unit 130 with three or even more nanofiltration devices 131. Providing a plurality of nanofiltration devices 131 arranged in parallel has the advantage that one of the nanofiltration devices 131 can be taken offline, while the remaining nanofiltration devices 131 remain online and provide the nanofiltered seawater to the pump 1. As it is known in the art, each of the nanofiltration devices 131 comprises a membrane (not shown). In addition, each of the nanofiltration devices 131 comprises a feed inlet 132 for receiving the microfiltered seawater at a feed pressure, and two outlets 133, 134, namely a permeate outlet 133 and a concentrate outlet 134. The fluid that passed through the membrane of the respective nanofiltration device 131, e.g. the sulfate depleted seawater, reaches the permeate outlet 133. This fluid is the nanofiltered seawater. The reminder of the process fluid, which does not pass through the membrane, e.g. the sulfate enriched seawater, is also referred to as the concentrate. The concentrate reaches the concentrate outlet 134 and is discharged from the respective nanofiltration device 131.

The permeate outlets 133 of all nanofiltration devices are in fluid communication with a common permeate outlet 135 of the membrane filtration unit 130.

The pump 1 is configured for example according to the first embodiment or the second embodiment of the process fluid lubricated pump 1. The low pressure inlet 21 of the pump 1 is in fluid communication with the permeate outlet 135 of the membrane filtration unit 130 for receiving the nanofiltered seawater. For example, a piping connects the permeate outlet 135 with the low pressure inlet.

The pump 1 pressurizes the nanofiltered seawater and discharges the seawater through the high pressure outlet 22 of the pump 1 as indicated by arrow I in FIG. 13. The high pressure outlet 22 of the pump 1 is in fluid communication, e.g. by a piping, with a well (not shown) for injecting the seawater into a subterranean region, where the oil and/or gas reservoir is located.

FIG. 14 shows a schematic cross-sectional view of a second embodiment of a seawater injection system 100 according to the invention.

In the following description of the second embodiment of the seawater injection system 100 only the differences to the first embodiment are explained in more detail. The explanations with respect to the first embodiment are also valid in the same way or in analogously the same way for the second embodiment. Same reference numerals designate the same features that have been explained with reference to the first embodiment or functionally equivalent features.

Compared to the first embodiment, it is the main difference, that the second embodiment of the seawater injection system 100 comprises a feed pump for feeding the microfiltered seawater to the membrane filtration unit. It is the second pump section 32 of a pump 1 according to the invention that constitutes said feed pump.

The second embodiment of the seawater injection system 100 comprises the pump 1, which is configured according to the third embodiment (FIG. 6) or according to the fourth embodiment (FIG. 9) of the pump 1.

The second embodiment of the seawater injection system 100 can be used for example in shallow water applications, where the hydrostatic pressure of the seawater is not sufficient for operating the membrane filtration unit 130. This might be e.g. an application, where the system 100 is installed on a sea ground in a depth of 200 m below the water surface. Of course, the second embodiment of the seawater injection system 100 is not restricted to such applications in shallow water, but can also be used for applications in deep water, e.g. at 1000*m* below the water surface or even deeper.

In the second embodiment of the seawater injection system 100 the second pump section 32 of the pump 1 functions as the feed pump for supplying the membrane filtration unit 130 with pre-filtered seawater. The first pump section 31 functions as the water injection pump for pressurizing the nanofiltered seawater.

Accordingly, the microfiltered seawater exiting the microfiltration unit 120 is supplied to the low pressure inlet 21 of the pump 1. The increased pressure outlet 23 of the pump 1 is connected to the feet inlets 132 of the nanofiltration devices 131 of the membrane filtration unit 130 for supplying the seawater to the membrane filtration unit 130. The increased pressure inlet 24 of the pump 1 is in fluid communication, e.g. by means of a piping, with the common permeate outlet 135 of the membrane filtration unit 130 for receiving the nanofiltered seawater. The high pressure outlet 22 of the pump 1 is in fluid communication with a well for injecting the seawater into a subterranean region, where the oil and/or gas reservoir is located.

What is claimed:

1. A process fluid lubricated pump for conveying a process fluid, comprising:

a common housing;

a pump arranged in the common housing;

a drive arranged in the common housing, the common housing comprising a low pressure inlet and a high pressure outlet for the process fluid, the pump comprising a pump shaft extending from a drive end to a non-drive end of the pump shaft and configured to rotate about an axial direction, and a first pump section having a first set of impellers fixedly mounted on the pump shaft and configured to increase the pressure of the process fluid, the drive configured to exert a torque on the drive end of the pump shaft to drive the rotation of the pump shaft;

a first balance drum fixedly connected to the pump shaft between the pump and the drive end of the pump shaft, the first balance drum defining a first front side facing the pump and a first back side;

a first relief passage disposed between the first balance drum and a first stationary part configured to be stationary with respect to the common housing, the first relief passage extending from the first front side to the first back side;

a second balance drum fixedly connected to the pump shaft between the pump and the non-drive end of the pump shaft, the second balance drum defining a second front side facing the pump and a second back side;

a second relief passage disposed between the second balance drum and a second stationary part configured to be stationary with respect to the common housing, the second relief passage extending from the second front side to the second back side; and a balance line connecting the first back side and the second back side.

2. The pump in accordance with claim 1, wherein the pump further comprises a second pump section having a second set of impellers fixedly mounted on the pump shaft and configured to increase the pressure of the process fluid, the first pump section and the second pump section arranged adjacent to each other with respect to the axial direction, a throttler is arranged between the first pump section and the second pump section to enable leakage of the process fluid from the first pump section to the second pump section, the common housing further comprises an increased pressure outlet and an increased pressure inlet for the process fluid, the second pump section is configured to receive the process fluid from the low pressure inlet and to discharge the process fluid through the increased pressure outlet, and the first pump section is configured to receive the process fluid from the increased pressure inlet and to discharge the process fluid through the high pressure outlet.

3. The pump in accordance with claim 1, wherein one of the first front side and the second front side is in fluid communication with the high pressure outlet.

4. The pump in accordance with claim 1, wherein the pump is a seal-less pump without a mechanical seal.

5. The pump in accordance with claim 1, further comprising a first pump bearing and a second pump bearing supporting the pump shaft, the first pump bearing arranged between the first balance drum and the drive, and configured to receive the process fluid passing through the first relief passage or through the balance line, the second pump bearing arranged between the second balance drum and the non-drive end or at the non-drive end, and configured to receive process the fluid passing through the balance line or through the second relief passage.

6. The pump in accordance with claim 1, wherein the drive comprises a drive shaft, an electric motor configured to rotate the drive shaft about the axial direction, a first and an second motor bearing supporting the drive shaft, the drive shaft is connected to the drive end of the pump shaft, the electric motor is arranged between the first motor bearing and the second motor bearing, and the drive is configured to receive process fluid from the first pump bearing to at least lubricate the first and the second motor bearing.

7. The pump in accordance with claim 6, wherein the balance line is arranged and configured to receive the process fluid discharged from the drive.

8. The pump in accordance with claim 6, further comprising an external cooling loop to cool and lubricate the motor bearings and the pump bearings by the process fluid, the external cooling loop comprising a heat exchanger to cool the process fluid, the heat exchanger arranged outside the common housing and configured to receive the process fluid from the drive and to supply the process fluid to the motor bearings or the pump bearings.

9. The pump in accordance with claim 6, wherein the pump comprises an intermediate take-off connected to a cooling loop, the intermediate take-off is configured to supply the process fluid to the cooling loop with a pressure that is larger than a pressure of the process fluid at the low pressure inlet, and the cooling loop is configured to supply the process fluid to the motor bearings or the pump bearings.

10. The pump in accordance with claim 2, wherein with respect to the axial direction the increased pressure inlet is arranged between the high pressure outlet and the increased pressure outlet, and the low pressure inlet is arranged between the increased pressure inlet and the increased pressure outlet.

11. The pump in accordance with claim 2, wherein the first set of impellers comprises a different number than the second set of impellers.

12. The pump in accordance with claim 2, wherein the first set of impellers and the second set of impellers are arranged in a back-to-back arrangement, so that an axial thrust generated by the first set of impellers is directed opposite to an axial thrust generated by the second set of impellers.

13. The pump in accordance with claim 2, wherein the pump is configured to be installed on a sea ground.

14. The pump in accordance with claim 2, wherein the first set of impellers comprises a larger number of impellers than the second set of impellers.

15. The pump in accordance with claim 2, wherein the pump is configured to be installed on a sea ground as a water injection pump for injecting seawater into a subterranean region.

16. A seawater injection system comprising:

a process fluid lubricated pump for conveying a process fluid, comprising a common housing, a pump arranged in the common housing, a drive arranged in the common housing, the common housing comprising a low pressure inlet and a high pressure outlet for the process fluid, the pump comprising a pump shaft extending from a drive end to a non-drive end of the pump shaft and configured to rotate about an axial direction, and a first pump section having a first set of impellers fixedly mounted on the pump shaft and configured to increase the pressure of the process fluid, the drive configured to exert a torque on the drive end of the pump shaft to drive the rotation of the pump shaft, a first balance drum fixedly connected to the pump shaft between the pump and the drive end of the pump shaft, the first balance drum defining a first front side facing the pump and a first back side, a first relief passage disposed between the first balance drum and a first stationary part configured to be stationary with respect to the common housing, the first relief passage extending from the first front side to the first back side, a second balance drum fixedly connected to the pump shaft between the pump and the non-drive end of the pump shaft, the second balance drum defining a second front side facing the pump and a second back side, a second relief passage disposed between the second balance drum and a second stationary part configured to be stationary with respect to the common housing, the second relief passage extending from the second front side to the second back side, and a balance line connecting the first back side and the second back side; and a membrane filtration unit configured to filter seawater, the process fluid being seawater, the low pressure inlet of the pump being connected to an outlet of the membrane filtration unit to receive filtered seawater, and the high pressure outlet of the pump is in fluid communication with a well for injecting seawater into a subterranean region.

17. The seawater injection system in accordance with claim 16, wherein the pump further comprises a second pump section having a second set of impellers fixedly mounted on the pump shaft and configured to increase the pressure of the process fluid, the first pump section and the second pump section arranged adjacent to each other with respect to the axial direction, a throttler is arranged between the first pump section and the second pump section to enable leakage of the process fluid from the first pump section to the second pump section, the common housing further comprises an increased pressure outlet and an increased pressure inlet for the process fluid, the second pump section is configured to receive the process fluid from the low pressure inlet and to discharge the process fluid through the increased pressure outlet, and the first pump section is configured to receive the process fluid from the increased pressure inlet and to discharge the process fluid through the high pressure outlet.

* * * * *